US012473809B2

(12) United States Patent
Saponja et al.

(10) Patent No.: US 12,473,809 B2
(45) Date of Patent: Nov. 18, 2025

(54) DOWNHOLE SEPARATOR

(71) Applicant: Oilify New-tech Solutions Inc., Calgary (CA)

(72) Inventors: Jeffrey Charles Saponja, Calgary (CA); Robbie Singh Hari, Calgary (CA)

(73) Assignee: Oilify New-tech Solutions Inc., Invermere (CA)

( * ) Notice: Subject to any disclaimer, the term of this patent is extended or adjusted under 35 U.S.C. 154(b) by 0 days.

(21) Appl. No.: 18/165,075

(22) Filed: Feb. 6, 2023

(65) Prior Publication Data

US 2023/0323763 A1 Oct. 12, 2023

Related U.S. Application Data

(60) Provisional application No. 63/306,888, filed on Feb. 4, 2022.

(51) Int. Cl.

| | |
|---|---|
| ***E21B 43/38*** | (2006.01) |
| ***E21B 43/12*** | (2006.01) |
| ***E21B 43/34*** | (2006.01) |

(52) U.S. Cl.

CPC ..... *E21B 43/38* (2013.01); *E21B 43/122* (2013.01); *E21B 43/126* (2013.01); *E21B 43/35* (2020.05)

(58) Field of Classification Search

CPC ..... E21B 43/38; E21B 43/36; E21B 43/122; E21B 43/34; E21B 43/126; E21B 43/35; E21B 43/385; E21B 43/40; E21B 43/13

See application file for complete search history.

(56) References Cited

U.S. PATENT DOCUMENTS

| | | | | |
|---|---|---|---|---|
| 10,584,571 | B2 | 3/2020 | Leitch | |
| 10,934,828 | B2 | 3/2021 | Downing | |
| 2011/0278015 | A1* | 11/2011 | Mazzanti | E21B 33/12 166/372 |
| 2016/0333681 | A1* | 11/2016 | Mazzanti | E21B 43/35 |
| 2017/0268322 | A1 | 9/2017 | Culbertson et al. | |
| 2018/0223642 | A1* | 8/2018 | Zahran | E21B 43/38 |
| 2018/0291706 | A1* | 10/2018 | Kehoe | E21B 43/35 |
| 2019/0085677 | A1* | 3/2019 | Marshall | F04B 47/12 |
| 2019/0309768 | A1* | 10/2019 | Todd | E21B 43/35 |
| 2021/0381338 | A1* | 12/2021 | Coyes | E21B 34/08 |
| 2022/0389805 | A1 | 12/2022 | Marshall | |
| 2023/0064086 | A1* | 3/2023 | Fotiades | E21B 43/34 |

* cited by examiner

*Primary Examiner* — Nicole Coy
*Assistant Examiner* — Jennifer A Railey
(74) *Attorney, Agent, or Firm* — Smart & Biggar LP

(57) ABSTRACT

There is provided a system for producing hydrocarbon material from a subterranean formation. The system includes a separator for separating gaseous material from reservoir fluid obtained from the subterranean formation. The system is configured to mitigate interference to the separation.

18 Claims, 23 Drawing Sheets

DOWNHOLE SEPARATOR

CROSS-REFERENCE TO RELATED APPLICATION

This application claims the benefits of priority to U.S. Provisional Patent Application No. 63/306,888, filed Feb. 4, 2022, titled DOWNHOLE SEPARATOR, the contents of which are hereby expressly incorporated into the present application by reference in their entirety.

FIELD

The present disclosure relates to mitigating gas interference with downhole pump operation during hydrocarbon production.

BACKGROUND

Reservoir fluids often contain entrained gases and solids. In producing reservoir fluids containing a relatively substantial fraction of gaseous material, the presence of such gaseous material hinders production by contributing to sluggish flow, and interfering with pump operation. As well, the presence of solids interferes with pump operation, including contributing to erosion of mechanical components.

Separators are provided help remedy or mitigate downhole pump gas interference during hydrocarbon production. However, separators often occupy relatively significant amounts of space within a wellbore, rendering efficient separation of gaseous material that is entrained within the reservoir fluid difficult. Some separators are complex structures and are associated with increased material and manufacturing costs. Accordingly, efficient and cost effective separation of gaseous material that is entrained within the reservoir fluid is desirable.

SUMMARY

In one aspect, there is provided a downhole separator, implacable within a wellbore string passage of a wellbore string that is lining a wellbore, for effectuating separation of a reservoir fluid flow, received within a reservoir fluid-receiving zone of the wellbore from a subterranean formation, into at least a gas-depleted reservoir fluid flow and a gas-enriched reservoir fluid flow, wherein: the separator is configured to co-operate with the wellbore string, wherein the co-operation is with effect that: flow communication is established between the reservoir fluid-receiving zone and an uphole wellbore zone; and reservoir fluid flow, received within the reservoir fluid-receiving zone, is conducted uphole to the uphole wellbore zone, with effect that the reservoir fluid flow is separated into at least the gas-depleted reservoir fluid flow and the gas-enriched reservoir fluid flow, wherein the separation includes separation in response to buoyancy forces within a gas separation zone; and the separator comprises: a flow diverter configured to co-operate with the gas separation zone for diverting the separated gas-depleted reservoir fluid flow such that the separated gas-depleted reservoir fluid flow is conducted in an upwardly direction; wherein: the flow diverter includes: a reservoir fluid-derived flow conductor effective for conducting a reservoir fluid-derived flow, derived from the uphole wellbore zone-disposed reservoir fluid flow, with effect that a downwardly-displaced reservoir fluid-derived flow, derived from the reservoir fluid-derived flow, becomes emplaced below the uphole wellbore zone, wherein the upwardly conducted gas-depleted reservoir fluid is derived from the downwardly-displaced reservoir fluid-derived flow, wherein the reservoir fluid-derived flow conductor includes a filter-communicating flow conductor portion, a solids filtering apparatus, a permeate discharging communicator, and a retentate discharging communicator; wherein: the filter-communicating flow conductor portion, the solids filtering apparatus, the permeate discharging communicator, and the retentate discharging communicator are co-operatively configured such that, while the reservoir fluid-derived flow is being conducted by the flow conductor, a downwardly-flowing reservoir fluid-derived flow becomes emplaced within the filter communicating flow conductor portion, and in response to the emplacement of the downwardly-flowing reservoir fluid-derived flow within the filter communicating flow conductor portion: the downwardly-flowing reservoir fluid-derived fluid flow becomes disposed in mass transfer communication apparatus with the solids filtering apparatus, with effect that the downwardly-flowing reservoir fluid-derived flow is separated into a first solids-depleted reservoir fluid-derived fluid flow and a downwardly-flowing solids-enriched reservoir fluid-derived flow, with effect that: (i) the first solids-depleted reservoir fluid-derived flow is discharged from the flow conductor via a permeate discharging communicator, disposed below the uphole wellbore zone, (ii) the downwardly-flowing solids-enriched reservoir fluid-derived flow is discharged from the flow conductor via a retentate discharging communicator, disposed below the uphole wellbore zone, with effect that the downwardly-flowing solids-enriched reservoir fluid-derived flow becomes emplaced in a solids settling zone, and while disposed in the solids settling zone, the solids-enriched reservoir fluid-derived flow becomes depleted in solid material in response to gravity separation such that a second solids-depleted reservoir fluid-derived flow is obtained, and (iii) at least a portion of the downwardly-displaced reservoir fluid-derived flow is derived from the first solids-depleted reservoir fluid.

In another aspect, there is provided a downhole solids separator, implacable within a wellbore string passage of a wellbore string that is lining a wellbore, for separating solids from reservoir material derived from a subterranean formation, comprising: a reservoir fluid flow conductor for conducting the reservoir fluid, wherein the reservoir fluid flow conductor includes a filter-communicating flow conductor portion; a solids filtering apparatus; a permeate discharging communicator; and a retentate discharging communicator; wherein: the solids filtering apparatus and the permeate discharging communicator and the retentate discharging communicator are co-operatively configured to co-operate with a reservoir fluid flowing through the reservoir fluid conductor such that, while the reservoir fluid flow is being conducted by the flow conductor, a downwardly-flowing reservoir fluid flow becomes emplaced within the filter communicating flow conductor portion, and in response to the emplacement of the downwardly-flowing reservoir fluid flow within the filter communicating flow conductor portion: the downwardly-flowing reservoir fluid flow becomes disposed in mass transfer communication apparatus with the solids filtering apparatus, with effect that the downwardly-flowing reservoir fluid flow is separated into a first solids-depleted reservoir fluid flow and a downwardly-flowing solids-enriched reservoir fluid flow, with effect that: (i) the first solids-depleted reservoir fluid flow is discharged from the flow conductor via a permeate discharging communicator, (ii) the downwardly-flowing solids-enriched reservoir fluid flow is discharged from the flow conductor via a retentate discharging communicator.

In another aspect, there is provided a downhole separator, implacable within a wellbore string passage of a wellbore string that is lining a wellbore, for effectuating separation of a reservoir fluid flow, received within a reservoir fluid-receiving zone of the wellbore from a subterranean formation, into at least a gas-depleted reservoir fluid flow and a gas-enriched reservoir fluid flow, wherein: the separator is configured to co-operate with the wellbore string, wherein the co-operation is with effect that: flow communication is established between the reservoir fluid-receiving zone and an uphole wellbore zone; and reservoir fluid flow, received within the reservoir fluid-receiving zone, is conducted uphole to the uphole wellbore zone, with effect that the reservoir fluid flow is separated into at least the gas-depleted reservoir fluid flow and the gas-enriched reservoir fluid flow, wherein the separation includes separation in response to buoyancy forces within a gas separation zone; and the separator comprises: a flow diverter configured to co-operate with the gas separation zone for diverting the separated gas-depleted reservoir fluid flow such that the separated gas-depleted reservoir fluid flow is conducted in an upwardly direction; wherein: the flow diverter includes: a reservoir fluid-derived flow conductor effective for conducting a reservoir fluid-derived flow, derived from the uphole wellbore zone-disposed reservoir fluid flow, with effect that a downwardly-displaced reservoir fluid-derived flow, derived from the conducted reservoir fluid-derived flow, becomes emplaced below the uphole wellbore zone, wherein the upwardly flowing gas-depleted reservoir fluid is derived from the downwardly-displaced reservoir fluid-derived flow, wherein the reservoir fluid-derived flow conductor includes a filter-communicating flow conductor portion, a solids filtering apparatus, a permeate discharging communicator, and a retentate discharging communicator; wherein: the filter-communicating flow conductor portion, the solids filtering apparatus, the permeate discharging communicator, and the retentate discharging communicator are co-operatively configured such that, while the reservoir fluid-derived flow is being conducted by the flow conductor, a downwardly-flowing reservoir fluid-derived flow becomes emplaced within the filter communicating flow conductor portion, and in response to the emplacement of the downwardly-flowing reservoir fluid-derived flow within the filter communicating flow conductor portion: the downwardly-flowing reservoir fluid-derived flow becomes disposed in mass transfer communication apparatus with the solids filtering apparatus, with effect that the downwardly-flowing reservoir fluid-derived flow is separated into a first solids-depleted reservoir fluid-derived fluid flow and a downwardly-flowing solids-enriched reservoir fluid-derived flow, with effect that the first solids-depleted reservoir fluid-derived flow is discharged from the flow conductor via a permeate discharging communicator, disposed below the uphole wellbore zone to define at least a portion of the downwardly-displaced reservoir fluid-derived flow; the solids filtering apparatus includes a filtering medium for effectuating the separation; the filter communicating flow conductor portion includes a filtering medium-traversing portion, through which the downwardly-flowing reservoir fluid-derived flow is flowing while the downwardly-flowing reservoir fluid-derived fluid flow is disposed in mass transfer communication apparatus with the filtering medium, and the filtering medium-traversing portion co-operates with the downwardly-flowing reservoir fluid-derived flow such that flowing of the downwardly-flowing reservoir fluid-derived flow, through the filtering medium-traversing portion, is with effect that the downwardly-flowing reservoir fluid-derived flow traverses the filtering medium; and the traversing of the filtering medium by the downwardly-flowing reservoir fluid-derived flow is with effect that the downwardly-flowing reservoir fluid-derived flow is conducted in a cross-flow orientation relative to the filtering medium.

In another aspect, there is provided a system for producing hydrocarbon material from an oil reservoir within a subterranean formation, comprising a pump and a downhole separator, implacable within a wellbore string passage of a wellbore string that is lining a wellbore, for effectuating separation of a reservoir fluid flow, received within a reservoir fluid-receiving zone of the wellbore from a subterranean formation, into at least a gas-depleted reservoir fluid flow and a gas-enriched reservoir fluid flow, wherein: the separator is configured to co-operate with the wellbore string, wherein the co-operation is with effect that: flow communication is established between the reservoir fluid-receiving zone and an uphole wellbore zone; and reservoir fluid flow, received within the reservoir fluid-receiving zone, is conducted uphole to the uphole wellbore zone, with effect that the reservoir fluid flow is separated into at least the gas-depleted reservoir fluid flow and the gas-enriched reservoir fluid flow, wherein the separation includes separation in response to buoyancy forces within a gas separation zone; and the separator comprises: a flow diverter configured to co-operate with the gas separation zone for diverting the separated gas-depleted reservoir fluid flow such that the separated gas-depleted reservoir fluid flow is conducted in an upwardly direction; wherein: the flow diverter includes: a reservoir fluid-derived flow conductor effective for conducting a reservoir fluid-derived flow, derived from the uphole wellbore zone-disposed reservoir fluid flow, with effect that a downwardly-displaced reservoir fluid-derived flow, derived from the conducted reservoir fluid-derived flow, becomes emplaced below the uphole wellbore zone, wherein the upwardly flowing gas-depleted reservoir fluid is derived from the downwardly-displaced reservoir fluid-derived flow, wherein the reservoir fluid-derived flow conductor includes a filter-communicating flow conductor portion, a solids filtering apparatus, a permeate discharging communicator, and a retentate discharging communicator; wherein: the filter-communicating flow conductor portion, the solids filtering apparatus, the permeate discharging communicator, and the retentate discharging communicator are co-operatively configured such that, while the reservoir fluid-derived flow is being conducted by the flow conductor: a downwardly-flowing reservoir fluid-derived flow becomes emplaced within the filter communicating flow conductor portion, and, in response to the emplacement of the downwardly-flowing reservoir fluid-derived flow within the filter communicating flow conductor portion, the downwardly-flowing reservoir fluid-derived fluid flow becomes disposed in mass transfer communication apparatus with the solids filtering apparatus, with effect that the downwardly-flowing reservoir fluid-derived flow is separated into a first solids-depleted reservoir fluid-derived fluid flow and a downwardly-flowing solids-enriched reservoir fluid-derived flow, with effect that the first solids-depleted reservoir fluid-derived flow is discharged from the flow conductor via a permeate discharging communicator, disposed below the uphole wellbore zone to define at least a portion of the downwardly-displaced reservoir fluid-derived flow; the solids filtering apparatus includes a filtering medium for effectuating the separation; wherein: the pump is fluidly coupled to downhole separator, via a gas-depleted reservoir fluid flow conductor, for effectuating supply of the separated gas-depleted reservoir fluid flow from the downhole separator to the pump; the system is configurable in a production-effective configuration and a flow reversal configuration; in the production-effective configuration, the system is configured for generating the gas-depleted reservoir fluid flow, such that, while the gas-depleted reservoir fluid flow is being generated: the reservoir fluid-derived flow is being conducted in the uphole direction, and the accumulated solid material is becoming adhered to the filtering medium, such that adhered solid material is obtained, and an uphole-disposed reservoir fluid-derived fluid material becomes disposed uphole relative to the filtering medium; and in the flow reversal configuration, the system is configured such that, while the uphole-disposed reservoir fluid-derived fluid material is disposed uphole relative to the filtering medium, the uphole-disposed reservoir fluid-derived fluid material is conductible through the filtering medium in a downhole direction, and while the adhered solid material is adhered to the filtering medium, and the uphole-disposed reservoir fluid-derived fluid material is being conducted in the downwardly direction: the adhered solid material becomes released from the filtering medium, such that the adherence of the adhered solid material to the filtering medium is defeated, and such that released solid material is obtained.

In another aspect, there is provided a method for producing hydrocarbon material from an oil reservoir within a subterranean formation with a system comprising a pump and a downhole separator, implacable within a wellbore string passage of a wellbore string that is lining a wellbore, for effectuating separation of a reservoir fluid flow, received within a reservoir fluid-receiving zone of the wellbore from a subterranean formation, into at least a gas-depleted reservoir fluid flow and a gas-enriched reservoir fluid flow, wherein: the separator is configured to co-operate with the wellbore string, wherein the co-operation is with effect that: flow communication is established between the reservoir fluid-receiving zone and an uphole wellbore zone; and reservoir fluid flow, received within the reservoir fluid-receiving zone, is conducted uphole to the uphole wellbore zone, with effect that the reservoir fluid flow is separated into at least the gas-depleted reservoir fluid flow and the gas-enriched reservoir fluid flow, wherein the separation includes separation in response to buoyancy forces within a gas separation zone; and the separator comprises: a flow diverter configured to co-operate with the gas separation zone for diverting the separated gas-depleted reservoir fluid flow such that the separated gas-depleted reservoir fluid flow is conducted in an upwardly direction; wherein: the flow diverter includes: a reservoir fluid-derived flow conductor effective for conducting a reservoir fluid-derived flow, derived from the uphole wellbore zone-disposed reservoir fluid flow, with effect that a downwardly-displaced reservoir fluid-derived flow, derived from the conducted reservoir fluid-derived flow, becomes emplaced below the uphole wellbore zone, wherein the upwardly flowing gas-depleted reservoir fluid is derived from the downwardly-displaced reservoir fluid-derived flow, wherein the reservoir fluid-derived flow conductor includes a filter-communicating flow conductor portion, a solids filtering apparatus, a permeate discharging communicator, and a retentate discharging communicator; wherein: the filter-communicating flow conductor portion, the solids filtering apparatus, the permeate discharging communicator, and the retentate discharging communicator are co-operatively configured such that, while the reservoir fluid-derived flow is being conducted by the flow conductor: a downwardly-flowing reservoir fluid-derived flow becomes emplaced within the filter communicating flow conductor portion, and, in response to the emplacement of the downwardly-flowing reservoir fluid-derived flow within the filter communicating flow conductor portion, the downwardly-flowing reservoir fluid-derived fluid flow becomes disposed in mass transfer communication apparatus with the solids filtering apparatus, with effect that the downwardly-flowing reservoir fluid-derived flow is separated into a first solids-depleted reservoir fluid-derived fluid flow and a downwardly-flowing solids-enriched reservoir fluid-derived flow, with effect that the first solids-depleted reservoir fluid-derived flow is discharged from the flow conductor via a permeate discharging communicator, disposed below the uphole wellbore zone to define at least a portion of the downwardly-displaced reservoir fluid-derived flow; the solids filtering apparatus includes a filtering medium for effectuating the separation; wherein: the pump is fluidly coupled to downhole separator for effectuating supply of the separated gas-depleted reservoir fluid flow from the downhole separator to the pump; the system is configurable in a production-effective configuration and a flow reversal configuration; in the production-effective configuration, the system is configured for generating the gas-depleted reservoir fluid flow, such that, while the gas-depleted reservoir fluid flow is being generated: the reservoir fluid-derived flow is being conducted in the uphole direction, and the accumulated solid material is becoming adhered to the filtering medium, such that adhered solid material is obtained, and an uphole-disposed reservoir fluid-derived fluid material becomes disposed uphole relative to the filtering medium; and in the flow reversal configuration, the system is configured such that, while the uphole-disposed reservoir fluid-derived fluid material is disposed uphole relative to the filtering medium, the uphole-disposed reservoir fluid-derived fluid material is conductible through the filtering medium in a downhole direction, and while the adhered solid material is adhered to the filtering medium, and the uphole-disposed reservoir fluid-derived fluid material is being conducted in the downwardly direction: the adhered solid material becomes released from the filtering medium, such that the adherence of the adhered solid material to the filtering medium is defeated, and such that released solid material is obtained; wherein the method comprising transitioning from the production configuration to the flow reversal configuration.

In another aspect, there is provided a system, for producing hydrocarbon material from an oil reservoir within a subterranean formation, comprising a pump and a downhole separator, implacable within a wellbore string passage of a wellbore string that is lining a wellbore, for effectuating separation of a reservoir fluid flow, received within a reservoir fluid-receiving zone of the wellbore from a subterranean formation, into at least a gas-depleted reservoir fluid flow and a gas-enriched reservoir fluid flow, wherein: the separator is configured to co-operate with the wellbore string, wherein the co-operation is with effect that: flow communication is established between the reservoir fluid-receiving zone and an uphole wellbore zone; and reservoir fluid flow, received within the reservoir fluid-receiving zone, is conducted uphole to the uphole wellbore zone, with effect that the reservoir fluid flow is separated into at least the gas-depleted reservoir fluid flow and the gas-enriched reservoir fluid flow, wherein the separation includes separation in response to buoyancy forces within a gas separation zone; the separator comprises a housing; a dip tube extending from the pump and into the housing; wherein: the housing and the dip tube co-operate to define a flow diverter; and the flow diverter is configured to co-operate with the gas separation zone for diverting the separated gas-depleted reservoir fluid flow such that the separated gas-depleted reservoir fluid flow is conducted in an upwardly direction; the housing defines: a reservoir fluid-derived flow conductor effective for conducting a reservoir fluid-derived flow, derived from the uphole wellbore zone-disposed reservoir fluid flow, with effect that a downwardly-displaced reservoir fluid-derived flow, derived from the reservoir fluid-derived flow, becomes emplaced below the uphole wellbore zone within a filtered flow receiving zone of the housing, wherein the upwardly conducted gas-depleted reservoir fluid is derived from the downwardly-displaced reservoir fluid-derived flow, wherein the reservoir fluid-derived flow conductor includes a filter-communicating flow conductor portion, a solids filtering apparatus, a permeate discharging communicator, and a retentate discharging communicator; wherein: the filter-communicating flow conductor portion, the solids filtering apparatus, the permeate discharging communicator, and the retentate discharging communicator are co-operatively configured such that, while the reservoir fluid-derived flow is being conducted by the flow conductor, a reservoir fluid-derived flow becomes emplaced within the filter communicating flow conductor portion, and in response to the emplacement of the reservoir fluid-derived flow within the filter communicating flow conductor portion: the reservoir fluid-derived fluid flow becomes disposed in mass transfer communication apparatus with the solids filtering apparatus, with effect that the reservoir fluid-derived flow is separated into a first solids-depleted reservoir fluid-derived fluid flow and a solids-enriched reservoir fluid-derived flow, with effect that: (i) the first solids-depleted reservoir fluid-derived flow is discharged from the flow conductor via a permeate discharging communicator, disposed below the uphole wellbore zone, (ii) the solids-enriched reservoir fluid-derived flow is discharged from the flow conductor via a retentate discharging communicator, disposed below the uphole wellbore zone, with effect that the solids-enriched reservoir fluid-derived flow becomes emplaced in a solids settling zone, and while disposed in the solids settling zone, the solids-enriched reservoir fluid-derived flow becomes depleted in solid material in response to gravity separation such that a second solids-depleted reservoir fluid-derived flow is obtained, and (iii) at least a portion of the downwardly-displaced reservoir fluid-derived flow is defined by the first solids-depleted reservoir fluid; and the dip tube effectuates supply of the separated gas-depleted reservoir fluid flow from the downhole separator to the pump.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
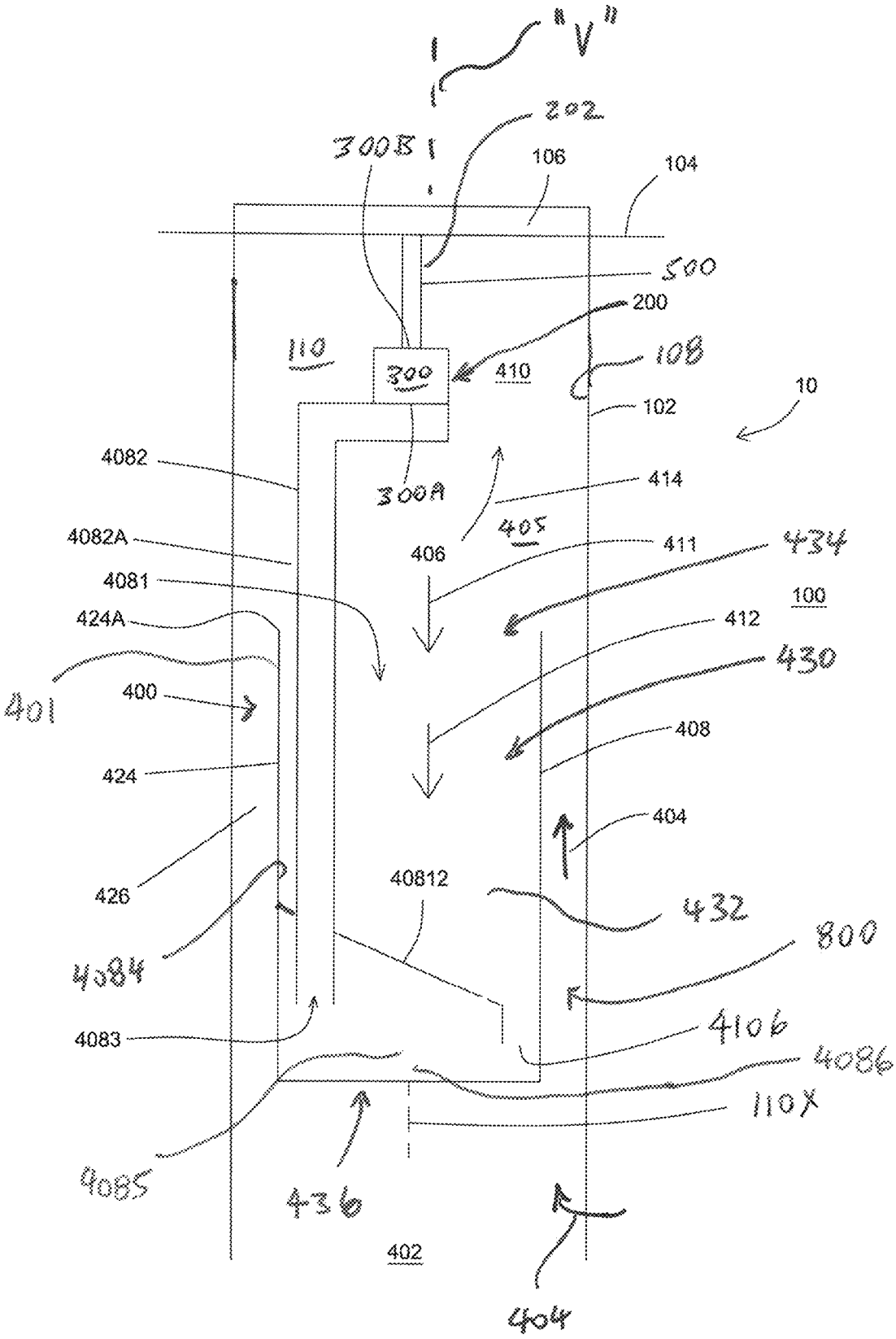
FIG. 1 is a schematic illustration of an embodiment of a reservoir production system, of the present disclosure, disposed within a wellbore.
Figure 2:
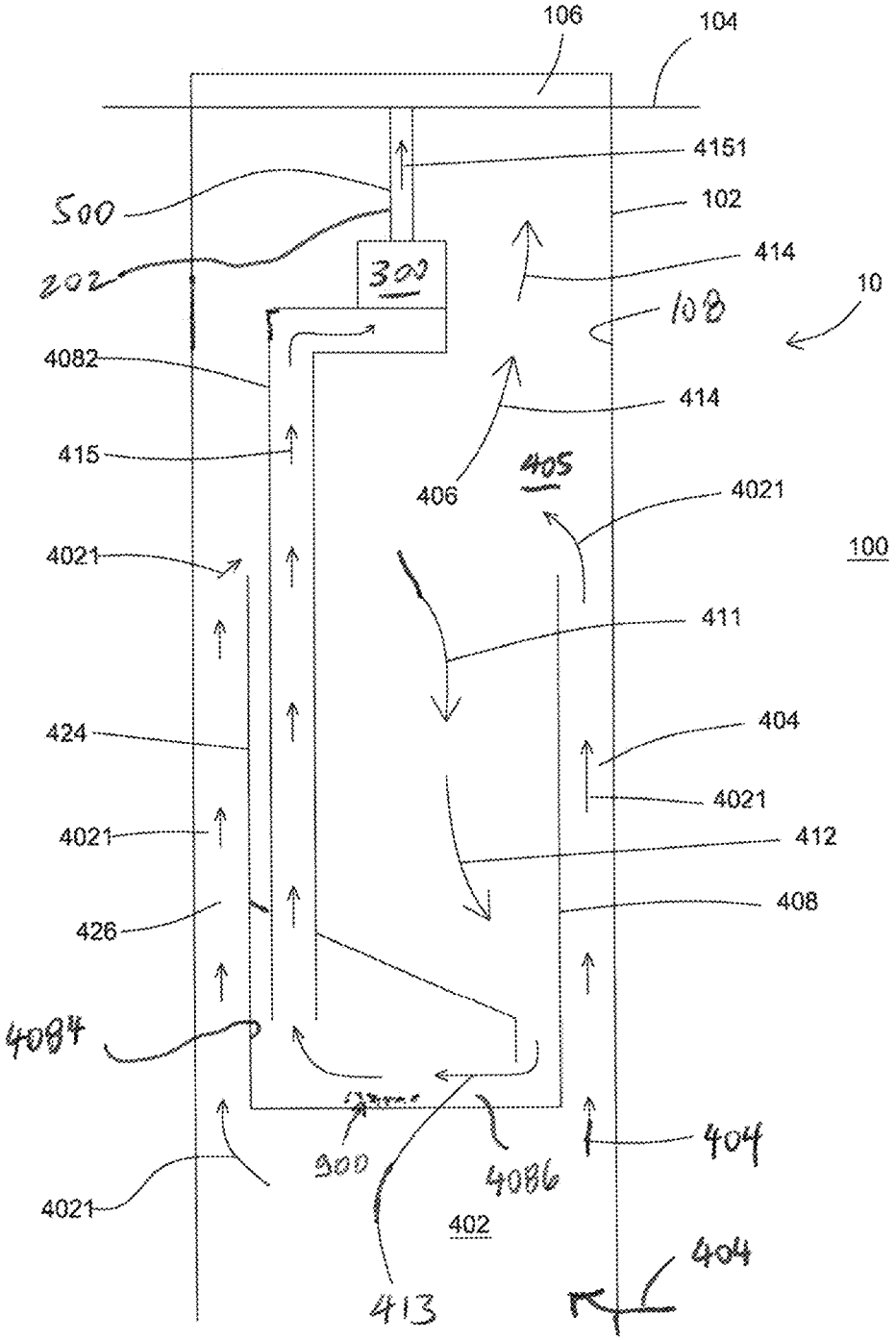
FIG. 2 is identical to the embodiment illustrated in FIG. 1, and illustrating fluid flows established during operation.

Referring to FIGS. 1 and 2, there is provided a system 10 for producing hydrocarbon material from an oil reservoir within a subterranean formation 100.

A wellbore 102 of a subterranean formation can be straight, curved or branched. The wellbore can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. In some embodiments, for example, the central longitudinal axis of the passage of a horizontal section is disposed along an axis that is between about 70 and about 110 degrees relative to the vertical, while the central longitudinal axis of the passage of a vertical section is disposed along an axis that is less than about 20 degrees from the vertical "V", and a transition section is disposed between the horizontal and vertical sections.

"Reservoir fluid" is fluid that is contained within an oil reservoir. Reservoir fluid can be liquid material, gaseous material, or a mixture of liquid material and gaseous material. The reservoir fluid includes hydrocarbon material, such as oil, natural gas condensates, or any combination thereof. The reservoir fluid can also contain water. The reservoir fluid can also include fluids injected into the reservoir for effecting stimulation of resident fluids within the reservoir.

A wellbore string 108 is emplaced within the wellbore 102 for stabilizing the subterranean formation 100. In some embodiments, for example, the wellbore string 108 also contributes to effecting fluidic isolation of one zone within the subterranean formation 100 from another zone within the subterranean formation 100.

The fluid productive portion of the wellbore 102 may be completed either as a cased-hole completion or an open-hole completion.

With respect to a cased-hole completion, in some embodiments, for example, a wellbore string 108, in the form of a wellbore casing that includes one or more casing strings, each of which is positioned within the wellbore 102, having one end extending from the wellhead 106, is provided. In some embodiments, for example, each casing string is defined by jointed segments of pipe. The jointed segments of pipe typically have threaded connections.

Typically, a wellbore 102 contains multiple intervals of concentric casing strings, successively deployed within the previously run casing. With the exception of a liner string, casing strings typically run back up to the surface 104. Typically, casing string sizes are intentionally minimized to minimize costs during well construction. Generally, smaller casing sizes make production and artificial lifting more challenging.

For wells that are used for producing reservoir fluid, few of these actually produce through the wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 106. In some embodiments, for example, the annular region between the last casing string and the production string may be sealed at the bottom by a packer.

The wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 10 receives the reservoir fluid.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 106. Cement may be provided within the annular region between the liner string and the oil reservoir for effecting zonal isolation (see below), but is not in all cases. In some embodiments, for example, this liner is perforated to effect flow communication between the reservoir and the wellbore. In some embodiments, for example, the production tubing string may be engaged or stung into the liner string, thereby providing a fluid passage for conducting the produced reservoir fluid to the wellhead 106.

An open-hole completion is established by drilling down to the producing formation, and then lining the wellbore (such as, for example, with a wellbore string 108). The wellbore is then drilled through the producing formation, and the bottom of the wellbore is left open (i.e. uncased), to effect flow communication between the reservoir and the wellbore.

The system 10 receives, via the wellbore 102, the reservoir fluid flow from the subterranean formation 100. As discussed above, the wellbore 102 is disposed in flow communication (such as through perforations provided within the installed casing or liner, or by virtue of the open hole configuration of the completion), or is selectively manipulated into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 10 receives the reservoir fluid.

In some embodiments, for example, the system 10 includes a production string, including a reservoir production assembly 200, disposed within a wellbore string passage 110 of the wellbore string 108. The reservoir production assembly 200 includes a separator 400, a pump 300, and a pressurized gas-depleted reservoir flow conductor 500. The pump 300 includes a suction 300A and a discharge 300B. The separator 400 is fluidly coupled to the pump suction 300A. The pressurized gas-depleted reservoir flow conductor 500 is fluidly coupled to the pump discharge 300B.

In some embodiments, for example, the pump 300 is a rod pump 300. In this respect, the reservoir production assembly 200 includes a production string 202, and the production string 202 defines the separator 400 and the pressurized gas-depleted reservoir fluid conductor 500. The rod pump 300 is emplaced within the production string 200. The rod pump 300 includes a conveyor 302, such as a rod or a rod string, extending through the pressurized gas-depleted reservoir fluid conductor 500, and connected to surface equipment which causes reciprocating movement of the conveyor 302. In some embodiments, for example, the surface equipment includes a prime mover (e.g. an internal combustion engine or a motor), a crank arm, and a beam. The prime mover rotates the crank arm, and the rotational movement of the crank arm is converted to reciprocal longitudinal movement through the beam. In some embodiments, for example, the prime mover is a pumpjack. The beam is attached to a polished rod by cables hung from a horsehead at the end of the beam. The polished rod passes through a stuffing box and is attached to the conveyor 302. Accordingly, the surface equipment effects reciprocating longitudinal movement of the conveyor 302, and further defines the upper and lower displacement limits of the conveyor 302. Reservoir fluid is produced to the surface in response to reciprocating longitudinal movement of the rod 302 by the pumpjack.

FIGS. 19 and 20A to 20D depict an example embodiment of the rod pump 300. In some embodiments, for example, the rod pump 300 further includes a plunger 308, and the plunger includes a traveling valve 306. The plunger 308 is connected to the conveyor 302 such that the plunger 308 (and, therefore, the traveling valve 306) displaces with the conveyor 302. The pump 300 further includes a barrel 304 that includes a standing valve 310. The barrel 304 is configured to receive the plunger 308 and, in this respect, the plunger 308 is moveable relative to the barrel 304 such that the traveling valve 306 is displaceable, relative to the standing valve 310, for positioning relative to the standing valve 310 within a range of positions uphole of the standing valve 310. A pump cavity 312 is defined between the standing valve 310 and the traveling valve 306, and its volume is determinable based on the positioning of the traveling valve 306 relative to the standing valve 310.

Figure 19:
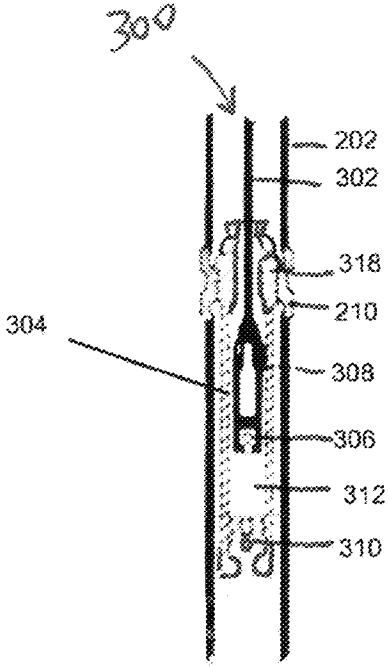
FIG. 19 is a schematic illustration of an embodiment of a rod pump for use in any one of the embodiments of the reservoir production system.

In some embodiments, for example, as depicted in FIG. 19, the barrel 304 includes a hold down 318, and the production string 202 defines a seating nipple 210. The hold down 318 and the seating nipple 210 are co-operatively configured for effecting mounting of the barrel to the production string 202 such that the pump 300 becomes emplaced within the production string 202. In some embodiments, for example, the mounting is with effect that the standing valve 310 remains stationary as the rod 302 is displaced. To emplace the pump 300 in the production string 202, the pump 300 is lowered, from the surface, into the production string 202 to effect engagement of the hold down 318 and the seating nipple 210, such that the barrel 304 is connected to the production string 202.

Figure 20D:
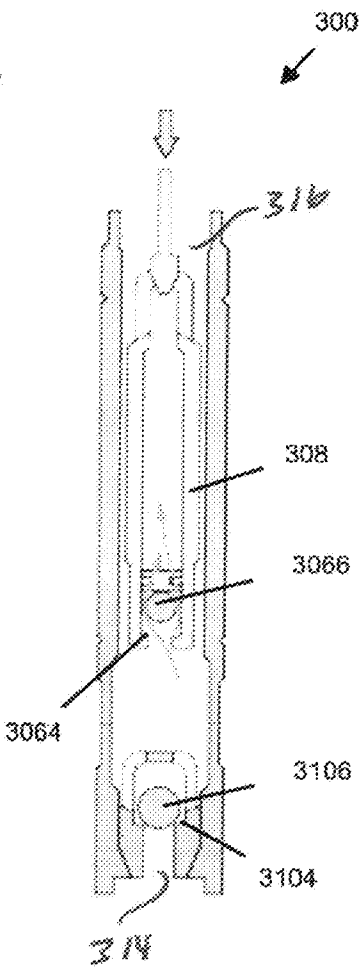
FIG. 20D is a schematic illustration of the rod pump of FIG. 20A, with the standing valve, traveling valve, pump cavity, and conveyer co-operatively configured in a pump cavity-evacuation configuration.
Figure 20C:
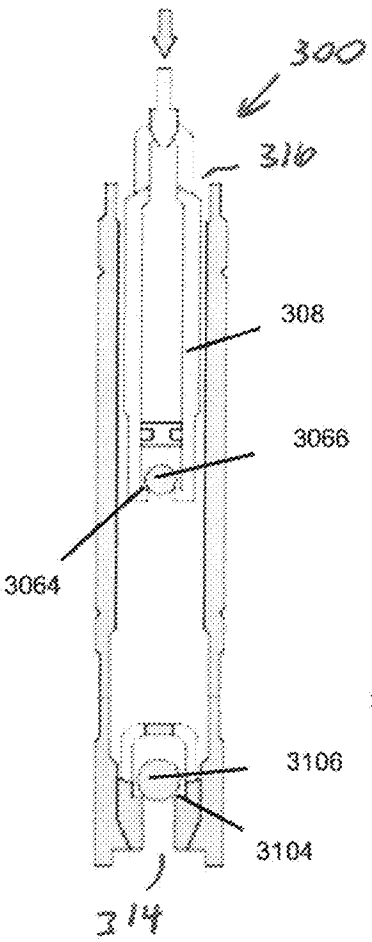
FIG. 20C is a schematic illustration of the rod pump of FIG. 20A, with the standing valve, traveling valve, pump cavity, and conveyer co-operatively configured in an uphole-disposed movement reversal configuration.

In some embodiments, for example, the traveling valve 306 defines a flow communicator 3062 and a seat 3064. As depicted in FIG. 20A, the traveling valve 306 includes a closure member 3066. In some embodiments, for example, the closure member 3066, the flow communicator 3062, and the seat 3064 are co-operatively configured such that, while the closure member 3066 is seated on the seat 3064, the flow communicator 3062 is occluded by the closure member 3066. In some embodiments, for example, the occlusion is with effect that the flow communicator 3062 is closed.

In some embodiments, for example, the closure member 3066, the flow communicator 3062, and the seat 3064 are further co-operatively configured such that, while the closure member 3066 is unseated (i.e. spaced apart) relative to the seat 3064, fluid flow is conductible through the flow communicator 3062, and while fluid flow is being conducted through the flow communicator 3062, the closure member 3066 is obstructive to the conducted fluid flow, with effect that at least a portion of the conducted fluid flow is diverted past the closure member 3066.

In some embodiments, for example, the closure member 3066, the flow communicator 3062, and the seat 3064 are further co-operatively configured such that, while the closure member 3066 is seated on the seat 3064 such that the flow communicator 3062 is being occluded by the closure member 3066, unseating of the closure member 3066 is effectible in response to displacement of the closure member 3066, relative to the seat 3064, along an axis that is parallel to a central axis of the flow communicator 3062.

In some embodiments, for example, the closure member 3066, the flow communicator 3062, and the seat 3064 are further co-operatively configured such that, while the closure member 3066 is seated on the seat 3064 such that the flow communicator 3062 is being occluded by the closure member 3066, unseating of the closure member 3066 is effectible in response to displacement of the closure member 3066, relative to the seat 3064, along an axis that is perpendicular to the plane within which the flow communicator 3062 is disposed.

In some embodiments, for example, the closure member 3066 has an outermost surface, and at least a portion of the outermost surface is defined by an arcuate profile, wherein the at least a portion of the outermost surface, defined by an arcuate profile, is an arcuate profile-defining outermost surface. In this respect, in such embodiments, for example, the seat 3064 defines a seating surface 3064A, and at least a portion of the seating surface 3064A has an arcuate profile. The at least a portion of the seating surface 3064A having the arcuate profile is complementary to the arcuate profile-defining outermost surface of the closure member 3066. In this respect, the at least a portion of the seating surface 3064A, having the arcuate profile, receives seating of the arcuate profile-defining outermost surface of the closure member 3066, while the closure member 3066 is seated on the seat 3064.

In some of these embodiments, for example, the closure member 3066 is a plug, such as, for example, a ball or a dart. In some embodiments, for example, the closure member 3066 is a plug that is contained within a cage. In some embodiments, for example, the closure member 3066 is a poppet (such that the traveling valve 306 is a poppet valve).

In some embodiments, for example, the standing valve 310 defines a flow communicator 3102 and a seat 3104. As depicted in FIG. 20A, the standing valve 310 includes a closure member 3106. In some embodiments, for example, the closure member 3106, the flow communicator 3102, and the seat 3104 are co-operatively configured such that, while the closure member 3106 is seated on the seat 3104, the flow communicator 3102 is occluded by the closure member 3106. In some embodiments, for example, the occlusion is with effect that the flow communicator 3102 is closed.

In some embodiments, for example, the closure member 3106, the flow communicator 3102, and the seat 3104 are further co-operatively configured such that, while the closure member 3106 is unseated (e.g. spaced apart) relative to the seat 3104, fluid flow is conductible through the flow communicator 3102, and while fluid flow is being conducted through the flow communicator 3102, the closure member 3106 is obstructive to the conducted fluid flow, with effect that at least a portion of the conducted fluid flow is diverted past the closure member 3106.

In some embodiments, for example, the closure member 3106, the flow communicator 3102, and the seat 3104 are further co-operatively configured such that, while the closure member 3106 is seated on the seat 3104 such that the flow communicator 3102 is being occluded by the closure member 3106, unseating of the closure member 3106 is effectible in response to displacement of the closure member 3106, relative to the seat 3104, along an axis that is parallel to a central axis of the flow communicator 3102.

In some embodiments, for example, the closure member 3106, the flow communicator 3102, and the seat 3104 are further co-operatively configured such that, while the closure member 3106 is seated on the seat 3104 such that the flow communicator 3102 is being occluded by the closure member 3106, unseating of the closure member 3106 is effectible in response to displacement of the closure member 3106, relative to the seat 3104, along an axis that is perpendicular to the plane within which the flow communicator 3102 is disposed.

In some embodiments, for example, the closure member 3106 has an outermost surface, and at least a portion of the outermost surface is defined by an arcuate profile, wherein the at least a portion of the outermost surface, defined by an arcuate profile, is an arcuate profile-defining outermost surface. In this respect, in such embodiments, for example, the seat 3104 defines a seating surface 3104A, and at least a portion of the seating surface 3104A has an arcuate profile. The at least a portion of the seating surface 3104A having the arcuate profile is complementary to the arcuate profile-defining outermost surface of the closure member 3106. In this respect, the at least a portion of the seating surface 3104A, having the arcuate profile, receives seating of the arcuate profile-defining outermost surface of the closure member 3106, while the closure member 3106 is seated on the seat 3104.

In some of these embodiments, for example, the closure member 3106 is a plug, such as, for example, a ball or a dart. In some embodiments, for example, the closure member 3106 is a plug that is contained within a cage. In some embodiments, for example, the closure member 3106 is a poppet (such that the standing valve 310 is a poppet valve).

FIGS. 20A to 20D are schematic illustrations of different configurations of an embodiment of the rod pump 300.

As depicted in FIG. 20A, the rod pump 300 is configurable in a downhole-disposed movement reversal configuration. As depicted, in the downhole-disposed movement reversal configuration, the traveling valve 306 is closed and the standing valve 310 is closed.

In some embodiments, for example, the pump 300 is transitionable from the downhole-disposed movement reversal configuration (FIG. 20A) to the pump cavity-filling configuration (FIG. 20B) in response to displacement of the conveyer 302 in the uphole direction. In the pump cavity-filling configuration, the travelling valve 306 is closed and the standing valve 310 is open, and a pump cavity-filling operation is being effectuated.

While the pump 300 is disposed in the downhole-disposed movement reversal configuration, the conveyer 302 is displaceable uphole, and, in response to the uphole displacement of the conveyor 302, the transitioning of the pump 300 from the downhole-disposed movement reversal configuration to the pump cavity-filling configuration is effected. In this respect, while the rod pumping system 150 is emplaced within the wellbore 102 such that the pump 300 is disposed in the downhole-disposed movement reversal configuration, in response to the conveyer 302 being displaced in an uphole direction such that the travelling valve 306 is displaced away from the standing valve 310 with effect that volume of the pump cavity 312 is increased and pressure within the pump cavity 312 is being reduced, a sufficiently low opening pressure is established within the pump cavity 312.

At this point, fluid pressure of reservoir fluid disposed within the reservoir fluid receiving zone 402 exceeds the sufficiently low opening pressure within the pump cavity 312, such that an effective opening pressure differential is established across the closure member 3106 of the standing valve 310.

Figure 20B:
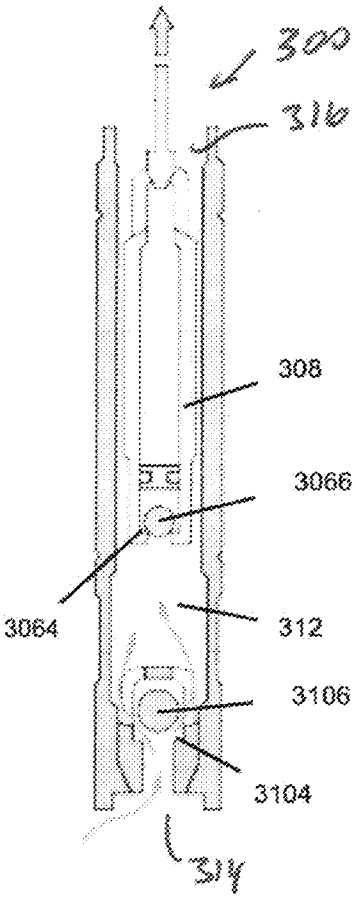
FIG. 20B is a schematic illustration of the rod pump of FIG. 20A, with the standing valve, traveling valve, pump cavity, and conveyer co-operatively configured in a pump cavity-filling configuration.
Figure 20A:
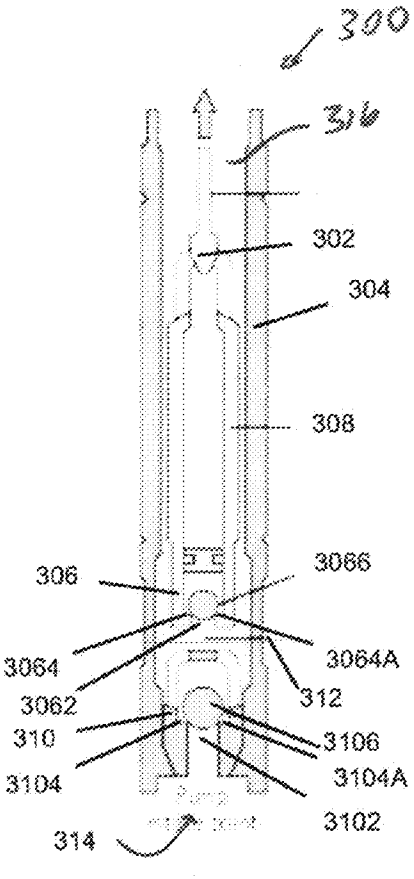
FIG. 20A is a schematic illustration of an embodiment of a rod pump for use in any one of the embodiments of the reservoir production system, with the standing valve, traveling valve, pump cavity, and conveyer co-operatively configured in a downhole-disposed movement reversal configuration.

In response to the effective opening pressure differential, the closure member 3106, which is seated on the seat 3104, becomes unseated from the valve seat 3104, such that the standing valve 310 becomes open, and reservoir fluid is induced to flow from the subterranean formation 100 to the wellbore 102, such that reservoir fluid immediately downhole 314 relative to the standing valve 310 (within the production string 202) is displaced through the stationary valve 310, and is received within the pump cavity 312, as depicted in FIG. 20B. In this respect, in some embodiments, for example, the standing valve 310 is openable in response to the effective opening pressure differential. In some embodiments, for example, the effective opening pressure differential is established in response to displacement of the conveyer 302 in the uphole direction, which effects displacement of the travelling valve 306 away from the standing valve 310 and thereby increases the volume of the pump cavity 312.

In this respect, in some embodiments, for example, the plunger 308, the traveling valve 306, the standing valve 310, and the pump cavity 312 are co-operatively configured such that, while the pump 300 is disposed in the downhole-disposed movement reversal configuration, in response to uphole displacement of the plunger 308:(i) the traveling valve 306 is urged to remain closed, and (ii) the standing valve 310 is urged to open, reservoir fluid is displaced from the subterranean formation 100 into the wellbore 102, with effect that reservoir fluid, disposed immediately downhole relative to the standing valve 310, becomes displaced, such that the displaced reservoir fluid becomes disposed within the pump cavity 312.

While the conveyor 302 continues to be displaced in an uphole direction such that the travelling valve 306 is further displaced away from the standing valve 310, and such that the volume of the pump cavity 312 continues to increase, a pressure differential is maintained, with effect that the closure member 3106 of the standing valve 310, which is unseated from the seat 3104, is urged to remain unseated from the valve seat 3104, such that the standing valve 310 remains open, and reservoir fluid continues to be displaced from the subterranean formation 100 into the wellbore 102 and is received within the pump cavity 312 via the standing valve 310.

Meanwhile, while the conveyer 302 is being displaced in an uphole direction, such that the traveling valve 306 is being displaced away from the standing valve 310, an effective closing pressure differential remains established across the closure member 3066 of the traveling valve 306. In this respect, fluid pressure, of fluid disposed immediately uphole relative to, and in fluid pressure communication with, the traveling valve 306, sufficiently exceeds the sufficiently low opening pressure within the pump cavity 312, such that an effective closing pressure differential is established across the closure member 3066 of the traveling valve 306. In response to the effective closing pressure differential, and, in combination with gravitational forces, the closure member 3066, which is seated on the seat 3064, is urged to remain seated on the valve seat 3064, such that the traveling valve 306 remains closed, and flow of reservoir fluid through the traveling valve 306 is prevented.

In parallel, while the pump 300 is disposed in the pump cavity-filling configuration, and the conveyor 302 is being displaced uphole, displacement of fluid, disposed uphole of the traveling valve 306 (for example, the reservoir fluid disposed in the uphole-disposed space 316), is urged, by the plunger 308, in the uphole direction.

As depicted in FIG. 20C, the pump 300 is configurable in an uphole-disposed movement reversal configuration. In the uphole-disposed movement reversal configuration, the traveling valve 306 is closed, and the standing valve 310 is closed. In the uphole-disposed movement reversal configuration, the traveling valve 306 is disposed uphole relative to its position in the downhole-disposed movement reversal configuration, and the volume of the pump cavity 312 is larger relative to its volume in the downhole-disposed movement reversal configuration.

The pump 300 is transitionable from the pump cavity-filling configuration (FIG. 20B) to the uphole-disposed movement reversal configuration (FIG. 20C). An exemplary embodiment of such transitioning will now be described. While the pump 300 is disposed in the pump cavity-filling configuration and the conveyor 302 is being displaced uphole, the conveyer 302 continues to be displaced uphole until the conveyer 302 has reached an uphole displacement limit as defined by the surface equipment, such that further uphole displacement of the traveling valve 306 relative to the standing valve 310 is prevented. In response to the suspension of the uphole displacement of the conveyer 302, over a pressure equalization time interval, fluid, disposed immediately downhole of the standing valve 306 (e.g. within the space 314), becomes disposed in fluid pressure equilibrium with fluid disposed within the pump cavity 312, such that there is an absence of a pressure differential across the closure member 3106. As a result, the closure member 3106 becomes seated on the seat 3104 due to the force of gravity applied to the closure member 3106, and flow of reservoir fluid through the standing valve 310 is prevented. In response to the suspension of the uphole displacement of the travelling valve 306, relative to the standing valve 310, because, initially, the closure member 3106 is unseated relative to the seat 3104 (as the pressure equalization is not immediate), flow of fluid is induced in the downhole direction, from the pump cavity 312 to the subterranean formation, via the reservoir fluid-supplying conductor 202. Such flow is useful for cleaning of a filtering medium 4122, as described below. After the pressure equalization time interval, once pressure is equalized and the closure member 3106 becomes seated on the seat 3104, this flow becomes suspended. Meanwhile, the travelling valve 306 remains closed during the transitioning of the pump 300 from the pump cavity-filling configuration to the uphole-disposed movement reversal configuration.

In some embodiments, for example, the pump 300 is transitionable from the uphole-disposed movement reversal configuration (FIG. 20C) to the pump cavity-evacuation configuration (FIG. 20D) in response to displacement of the conveyer 302 in the downhole direction. In the pump cavity-evacuation configuration, the travelling valve 306 is open and the standing valve 310 is closed, and a pump cavity-evacuation operation is being effectuated.

While the pump 300 is disposed in the uphole-disposed movement reversal configuration, the conveyer 302 is displaceable downhole, and, in response to the downhole displacement of the conveyor 302, the transitioning of the pump 300 from the uphole-disposed movement reversal configuration to the pump cavity-evacuation configuration is effected.

In this respect, while the pump 300 is emplaced within the production string 202 such that the pump 300 is disposed in the uphole-disposed movement reversal configuration, in response to the conveyer 302 being displaced in a downhole direction such that the travelling valve 306 is displaced towards the standing valve 310 with effect that volume of the pump cavity 312 becomes reduced, and fluid pressure within the pump cavity 312 is being increased such that a sufficiently high opening pressure is established within the pump cavity 312. At this point, a sufficiently high opening pressure differential is being established across the closure member 3066 of the traveling valve 306, between the pump cavity 312 and space 316 disposed immediately uphole relative to the traveling valve 306 (and disposed within the production string 202). The sufficiently high opening pressure differential is established by fluid pressure communication, to the closure member 3066, of a fluid pressure, of fluid that is disposed within the pump cavity 312, which exceeds fluid pressure of fluid disposed within the space 316 immediately uphole of the closure member 3066. As a result, the fluid within the pump cavity 312 urges unseating of the closure member 3066 from the valve seat 3064, thereby effecting opening of the travelling valve 306, and the fluid within the pump cavity 312 is displaced from the pump cavity 312, through the traveling valve 306, and becomes disposed within the production string 202, immediately uphole relative to the travelling valve 306.

Meanwhile, while the conveyer 302 is displacing in a downhole direction to displace the traveling valve 306 towards the standing valve 310, with effect that volume of the pump cavity 312 is being decreased and pressure within the pump cavity 312 is being increased, a sufficient closing pressure differential remains established across the closure member 3106 of the standing valve 310, between the pump cavity 312 and the downhole flow receiving communicator 314. In this respect, fluid pressure, of fluid within the pump cavity 312, sufficiently exceeds the pressure of fluid disposed immediately downhole of the standing valve 310, such that an effective closing pressure differential is established across the closure member 3106 of the standing valve 310. In response to the effective closing pressure differential, and, in combination with gravitational forces, the closure member 3106, which is seated on the seat 3104, is urged to remain seated on the valve seat 3104, such that the traveling valve 306 remains closed, and flow of reservoir fluid through the traveling valve 306 is prevented.

In this respect, in some embodiments, for example, the plunger 308, the traveling valve 306, the standing valve 310, and the pump cavity 312 are co-operatively configured such that, in response to downhole displacement of the plunger 308: (i) the standing valve 310 is urged to remain closed, and (ii) the traveling valve 306 is urged to open, with effect that at least a portion of the fluid within the pump cavity 312 is displaced from the pump cavity 312, with effect that the displaced fluid becomes disposed uphole relative to the travelling valve 306.

While the conveyor 302 continues to be displaced in a downhole direction such that the travelling valve 306 is further displaced towards the standing valve 310, the closure member 3066 of the traveling valve 306, which is unseated from the seat 3064, is urged to remain unseated from the valve seat 3064, such that the traveling valve 306 remains open, and fluid within the pump cavity 312 continues to be displaced from the pump cavity 312, through the traveling valve 306, and become disposed immediately uphole relative to the traveling valve 306.

Meanwhile, while the conveyer 302 is being displaced in the downhole direction, such that the traveling valve 306 is being displaced towards the standing valve 310, an effective closing pressure differential remains established across the closure member 3106 of the standing valve 310. In this respect, fluid pressure, of fluid within the pump cavity 312, continues to sufficiently exceed the pressure of fluid disposed immediately downhole relative to the standing valve, such that an effective closing pressure differential is established across the closure member 3106 of the standing valve 310. In response to the effective closing pressure differential, and, in combination with gravitational forces, the closure member 3106, which is seated on the seat 3104, is urged to remain seated on the valve seat 3104, such that the standing valve 310 remains closed, and flow of reservoir fluid through the standing valve 310 is prevented.

In some embodiments, for example, the pump 300 is transitionable from the pump cavity-evacuation configuration (FIG. 20D) to the downhole-disposed movement reversal configuration (FIG. 20A). In some of these embodiments, for example, the transitioning is effectible while the conveyor 302 is being displaced downhole.

While the pump 300 is disposed in the pump cavity-evacuation configuration and the conveyor 302 is being displaced downhole, the conveyer 302 continues to be displaced downhole until the conveyer 302 has reached a downhole displacement limit as defined by the surface equipment, such that further downhole displacement of the traveling valve 306 relative to the standing valve 310 is prevented. In response to the suspension of the downhole displacement of the conveyer 302, fluid, disposed immediately uphole of the traveling valve 310 (e.g. within the space 316), becomes disposed in fluid pressure equilibrium with fluid disposed within the pump cavity 312, such that there is an absence of a pressure differential across the closure member 3066. As a result, the closure member 3066 becomes seated on the seat 3064 due to the force of gravity applied to the closure member 3066, and flow of reservoir fluid through the traveling valve 306 is prevented. Meanwhile, the standing valve 310 remains closed during the transitioning of the pump 300 from the pump cavity-evacuation configuration to the downhole-disposed movement reversal configuration.

The sequence described in FIGS. 20A to 20D defines an operating cycle which is repeated, and the pump 300 continues to progressively pump reservoir fluid uphole towards the surface 106 with each successive cycle.

A reservoir fluid-receiving zone 402 is disposed within the wellbore string passage 110 for receiving reservoir fluid flow that is conducted from the subterranean formation 100 and into the wellbore 102. In this respect, reservoir fluid flow, from the subterranean formation 100, is received by the reservoir fluid-receiving zone 402. In some embodiments, for example, the reservoir fluid-receiving zone 402 is disposed within a horizontal section of the wellbore 102.

The separator 400 is configured to co-operate with the wellbore string 108 to define a gas separation zone 406, disposed uphole relative to, and in flow communication with, the reservoir fluid-receiving zone 402. While a reservoir fluid-derived flow, derived from the reservoir fluid flow received by the receiving zone 402, is disposed within the gas separation zone 406, in response to buoyancy forces, gaseous material is separated from the reservoir fluid-derived flow, with effect that a gas-depleted reservoir fluid flow 415 is obtained and a gas-enriched reservoir fluid flow 414 is obtained. In this respect, the gas separation zone 406 has a sufficiently large cross-sectional flow area, relative to that of the flow passage through which the reservoir fluid-derived flow is conducted from the receiving zone 402, with effect that the flowrate of the reservoir fluid-derived flow is sufficiently reduced so as to permit the separation. In some embodiments, for example, the reservoir fluid-derived flow is conducted in a downwardly direction (such that the reservoir fluid-derived flow is a downwardly-flowing reservoir fluid-derived flow).

The gas-depleted reservoir fluid flow 415 is supplied to the suction 300A of the pump 300, pressurized by the pump 300, with effect that the pressurized gas-depleted reservoir fluid is discharged via the pump discharge 300B and received by the pressurized gas-depleted reservoir flow conductor 500, for flow to the surface via the pressurized gas-depleted reservoir flow conductor 500. In parallel, the separated gaseous material is recoverable as a gas-enriched reservoir fluid flow 414, conducted upwardly to the surface 104 via a gas-enriched reservoir fluid-conducting passage 112 within the wellbore. The reservoir fluid produced from the subterranean formation 100, via the wellbore 102, including the gas-depleted reservoir fluid, the gas-enriched reservoir fluid, or both, may be discharged through the wellhead 106 to a collection facility, such as a storage tank within a battery.

In this respect, a fluid passage 800 is defined within the wellbore 102, extending from the reservoir fluid-receiving zone 402 to the pump 300, for supplying the gas-depleted reservoir fluid flow 415, derived from the reservoir fluid flow received by the receiving zone 402, to the pump 300, for pressurization by the pump 300 for flow to the surface 104 as flow 4151 via the pressurized gas-depleted reservoir flow conductor 500.

The separator 400 is configured to co-operate with the wellbore string 108. The co-operation is with effect that flow communication is established between the reservoir fluid-receiving zone 402 and an uphole wellbore zone 405. The co-operation is also with effect that reservoir fluid flow, received within the reservoir fluid-receiving zone 402, is conducted uphole to the uphole wellbore zone 405, with effect that the reservoir fluid flow is separated, in response to buoyancy forces, into at least the gas-depleted reservoir fluid flow 415 and a gas-enriched reservoir fluid flow 414 within the separation zone 406. The separation includes separation effectuated in response to buoyancy forces within a gas separation zone 406.

In some embodiments, for example, the uphole wellbore zone 405 is disposed above the reservoir fluid-receiving zone 402.

In some embodiments, for example, the gas separation zone 406 is disposed above the reservoir fluid-receiving zone 402.

In some embodiments, for example, the gas separation zone 406 is disposed within a passage of the wellbore 102 whose central longitudinal is disposed along an axis that is disposed at an acute angle of less than about 45 degrees from the vertical "V", such as, for example, less than about 35 degrees from the vertical "V".

In some embodiments, for example, the separator 400 includes a flow diverter 408. The flow diverter 408 is configured to co-operate with the gas separation zone 406 for diverting the separated gas-depleted reservoir fluid flow 415 such that the separated gas-depleted reservoir fluid flow 415 is conducted in an upwardly direction to the surface 104 via the pump 300. In some embodiments, for example, the separator 400 defines a housing 401, and the flow diverter 408 is defined within the housing 401.

In this respect, an upwardly flowing gas-depleted reservoir fluid 415 is obtained for conducting to the pump 300, for uphole displacement to the surface 104. In parallel, as a consequence of the separation, an upwardly flowing gas-enriched reservoir fluid (e.g. flow 4151) is obtained for conducting to the surface 104 via the gas-enriched reservoir fluid-conducting passage 112.

Figure 3:
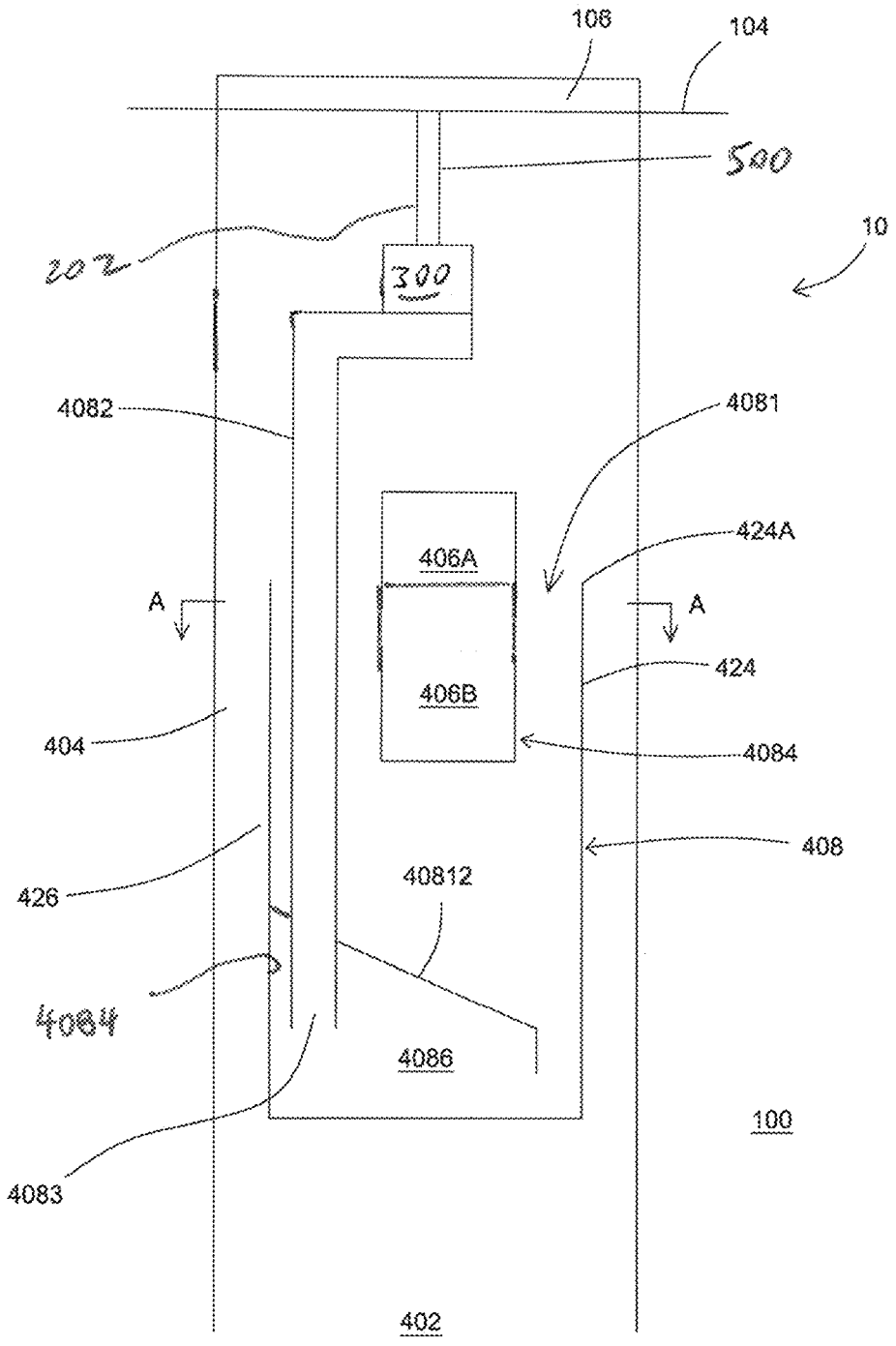
FIG. 3 is identical to the embodiment illustrated in FIG. 1, and illustrating establishment of a separation zone with portions within and above the flow diverter.
Figure 4:
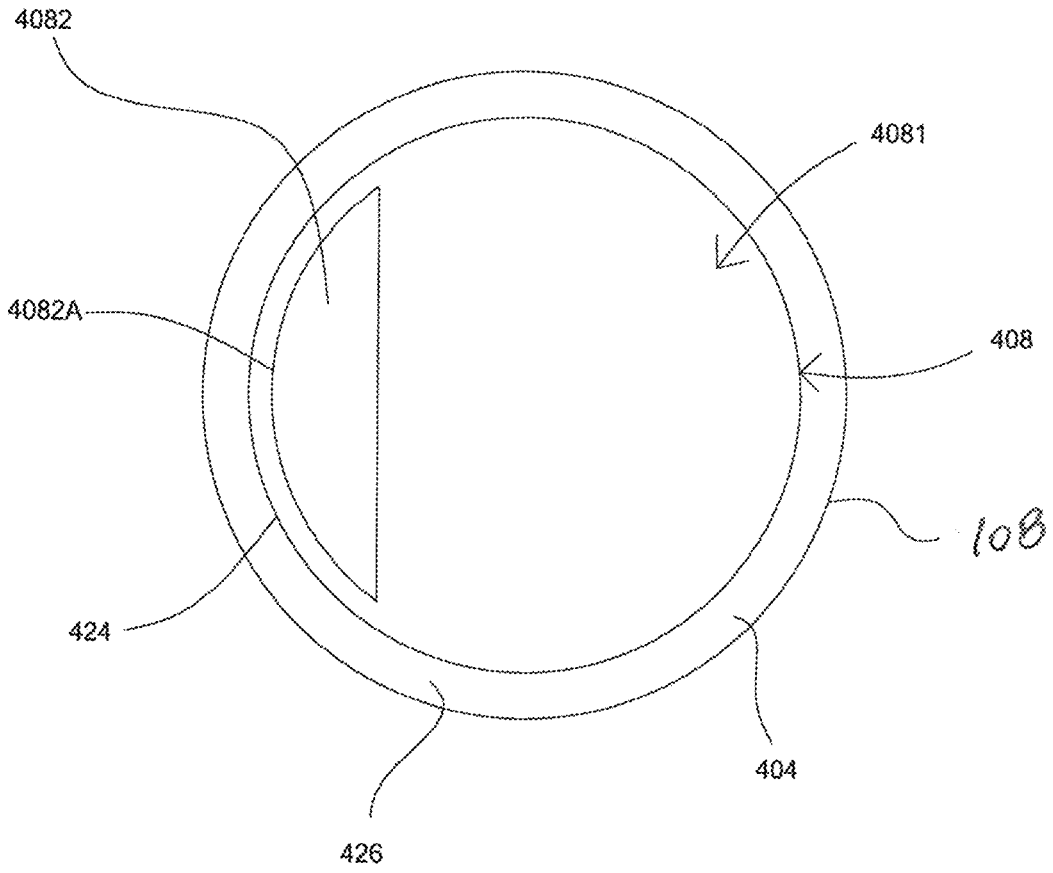
FIG. 4 is a schematic illustration of a sectional view of the embodiment illustrated in FIG. 3, taken along lines A-A in FIG. 3.

Referring to FIGS. 3 and 4, in some embodiments, for example, the flow diverter 408 includes a reservoir fluid-derived flow conductor 430 effective for conducting a reservoir fluid-derived flow 411, derived from the uphole wellbore zone-disposed reservoir fluid flow. The conducting of the reservoir fluid-derived flow 411, by the conductor 430, is with effect that a downwardly-displaced reservoir fluid-derived flow 413, derived from the conducted reservoir fluid-derived flow 411, becomes emplaced below the uphole wellbore zone 405. The upwardly flowing gas-depleted reservoir fluid 415 is derived from the downwardly-displaced reservoir fluid-derived flow 413. In some embodiments, for example, while the separator 400 is emplaced within the wellbore, the reservoir fluid-derived flow conductor 430 defines a central longitudinal axis disposed at an acute angle of less than 45 degrees from the vertical axis.

The flow diverter defines a flow-receiving communicator 4081. The reservoir fluid-derived flow is received by the flow conductor 430 via the flow-receiving communicator 4081. In this respect, in some embodiments, for example, the flow-receiving communicator 4081 functions as an inlet for the flow conductor 430.

In some embodiments, for example, while being received by the flow-receiving communicator 4081, the reservoir fluid-derived flow 411 is flowing in a downwardly direction. In some embodiments, for example, flow direction of the reservoir fluid-derived flow 411 is continued in the downhole direction and, in this respect, the conducting of such reservoir fluid-derived flow, by the flow conductor 430, is in the downwardly direction.

Figure 5:
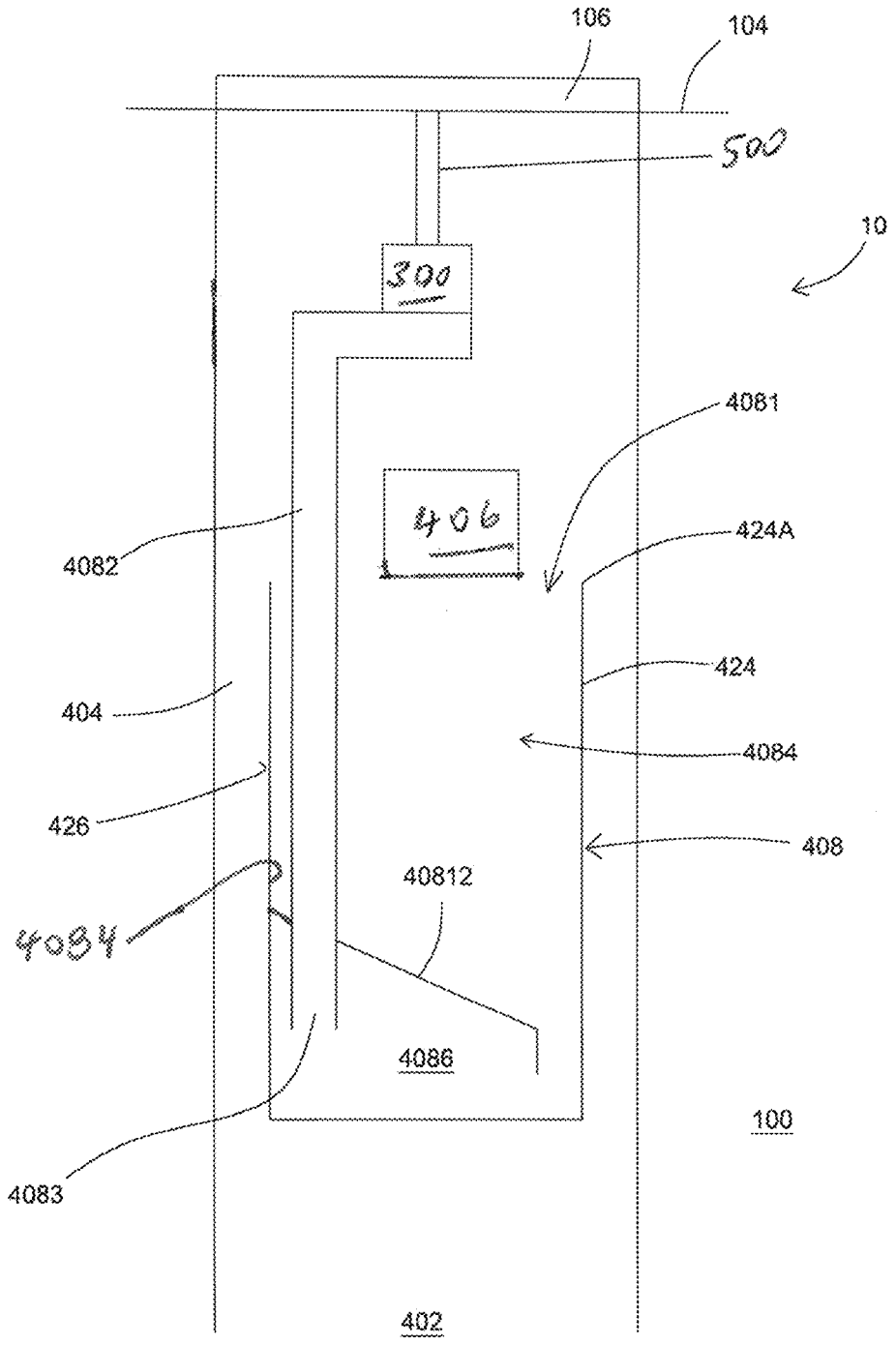
FIG. 5 is identical to the embodiment illustrated in FIG. 1, and illustrating establishment of a separation zone above the flow diverter.

Referring to FIG. 5, in some embodiments, for example, the gas separation zone 406 is disposed entirely above the flow-receiving communicator 4081, such that the separation of the reservoir fluid flow into a gas-depleted reservoir fluid and a gas-enriched reservoir fluid is effectuated above the flow-receiving communicator 4081. In this respect, in some embodiments, for example, the reservoir fluid-derived flow 411, received by the flow-receiving communicator 4081, is the gas-depleted reservoir fluid flow, and the downwardly-displaced reservoir fluid-derived flow 413 is the gas-depleted reservoir fluid flow.

Referring to FIG. 3, in some embodiments, for example, a portion of the gas separation zone 406 (portion 406A) is disposed above the flow-receiving communicator 4081, and the remaining portion of the gas separation zone 406 (portion 406B) is disposed within the flow diverter 408 (i.e. the flow conductor 430), such that some of the separation of the reservoir fluid flow into a gas-depleted reservoir fluid and a gas-enriched reservoir fluid is effectuated above the flow-receiving communicator 4081, and the remainder of the separation is effectuated within the flow diverter 408 (i.e. the flow conductor 430). In this respect, the separation is with effect that, while flowing downwardly within the flow conductor 430, the reservoir fluid-derived flow 411 becomes progressively depleted in gaseous material in response to at least buoyancy forces.

Figure 6:
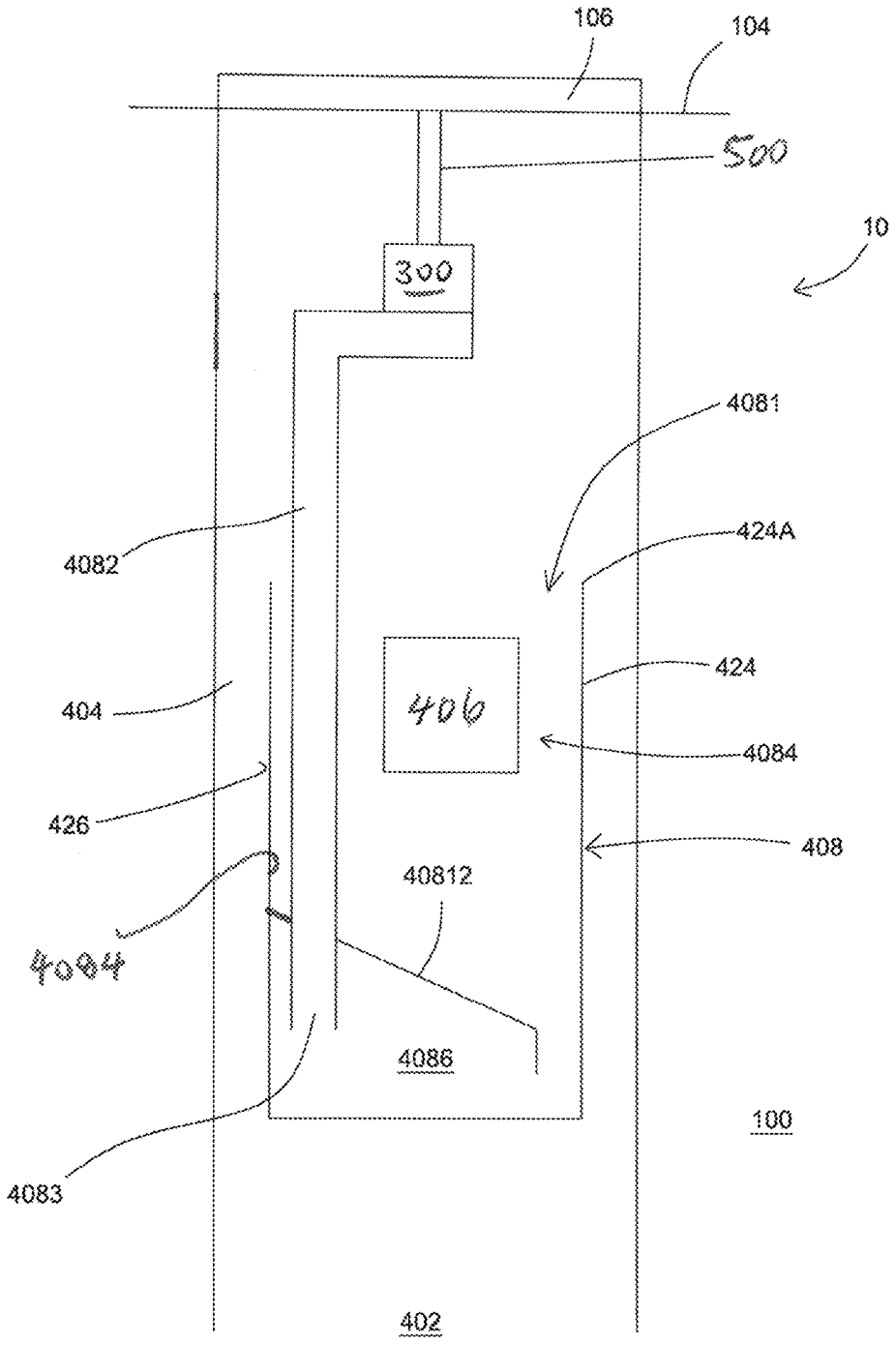
FIG. 6 is identical to the embodiment illustrated in FIG. 1, and illustrating establishment of a separation zone within the flow diverter.

Referring to FIG. 6, in some embodiments, for example, the entirety of the gas separation zone 406 is disposed within the flow diverter 408 (i.e. the flow conductor 430), such that the separation of the reservoir fluid flow into a gas-depleted reservoir fluid flow and a gas-enriched reservoir fluid flow takes place within the flow diverter 408 (i.e. the flow conductor 430). In this respect, the separation is with effect that, while flowing downwardly within the flow conductor 430, the reservoir fluid-derived flow 411 becomes progressively depleted in gaseous material in response to at least buoyancy forces.

In some embodiments, for example, the flow communication established between the reservoir fluid-receiving zone 402 and the uphole wellbore zone 405, by the co-operative configuration of the separator 400 and the wellbore string 108, is effectuated by a reservoir fluid-conducting passage 404. In this respect, the reservoir fluid-conducting passage 404 is established by the co-operative configuration of the separator 400 and the wellbore string 108. In some embodiments, for example, the reservoir fluid-conducting passage 404 is defined between the housing 401 and the wellbore string 108. The conducting of the reservoir fluid flow from the reservoir fluid-receiving zone 402 to the uphole wellbore zone 405 is effectuated by the reservoir fluid-conducting passage 404. In some embodiments, for example, such conducting is in an upwardly direction.

In some embodiments, for example, the emplacement of the production system 300 within the wellbore string 108 is with effect that an intermediate passage 426 is defined between the separator 400 (e.g. the housing 401) and the wellbore string 108. In some embodiments, for example, the intermediate passage 426 defines the reservoir fluid-conducting passage 404. In some embodiments, for example, the intermediate passage 426 is an annulus.

In some embodiments, for example, the flow receiving communicator 4081, of the flow diverter 408, has a cross-sectional flow area of at least six (6) inches squared. In some embodiments, for example, the ratio, of (ii) cross-sectional flow area of the wellbore string passage 108, to (ii) cross-sectional area of flow receiving communicator 4081, is less than 1.1:1.

Referring to FIGS. 1 and 2, in some embodiments, for example, the housing 401 of the separator 400 defines a shroud 424, which separates the flow conductor 430 of the flow diverter 408 from the intermediate passage 426. The upper edge 424A of the shroud 424 defines the flow receiving communicator 4081.

In some embodiments, for example, the flow diverter 408 further includes a gas-depleted reservoir fluid flow conductor 4082 for conducting the upwardly flowing gas-depleted reservoir fluid 415, such as, for example, to the pump 300. In this respect, the gas-depleted reservoir fluid flow conductor 4082 is connected to the pump suction 300A, such that the fluid coupling of the flow diverter 408 to the pump suction 300A is effectuated via the gas-depleted reservoir fluid flow conductor 4082. In this respect, the gas-depleted reservoir fluid flow conductor 4082 is fluidly coupled to the suction 300A of the pump 300, for conducting the separated gas-depleted reservoir fluid from the flow diverter 408 to the pump 500 as a flow 415. The gas-depleted reservoir fluid flow conductor 4082 defines a flow receiver 4083 (e.g. an inlet), which effects flow communication between the gas-depleted reservoir fluid flow conductor 4082 and the gas separation zone 406.

In some embodiments, for example, the gas-depleted reservoir fluid flow conductor 4082 is a dip tube extending from the suction 300A of the pump 300 and into the housing 401. In such embodiments, the housing 401 and the dip tube 4082 co-operate to define the flow diverter 408. In this respect, in such embodiments, the housing 401 defines the flow-receiving communicator 4081 and the flow conductor 430.

In this respect, the reservoir fluid-receiving zone 402 is disposed in flow communication with the suction 300A of the pump 300 via the flow conductor 430 and the gas-depleted reservoir fluid flow conductor 4082.

In some embodiments, for example, the ratio of the cross-sectional flow area of the flow diverter flow receiving communicator 4081 to the maximum cross-sectional flow area of the gas-depleted reservoir fluid flow conductor 4082 is at least 1:0.127.

In some embodiments, for example, the gas-depleted reservoir fluid flow conductor 4082 is co-operatively disposed relative to the gas separation zone 406 such that interference with the separation, within the gas separation zone 406, of the reservoir fluid into the gas-depleted reservoir fluid and the gas-enriched reservoir fluid, by the gas-depleted reservoir fluid flow conductor 4082 (such as, for example, resistance, provided by the gas-depleted reservoir fluid flow conductor 4082, to the upward movement of gaseous bubbles within the gas separation zone 406), is mitigated.

Figure 7:
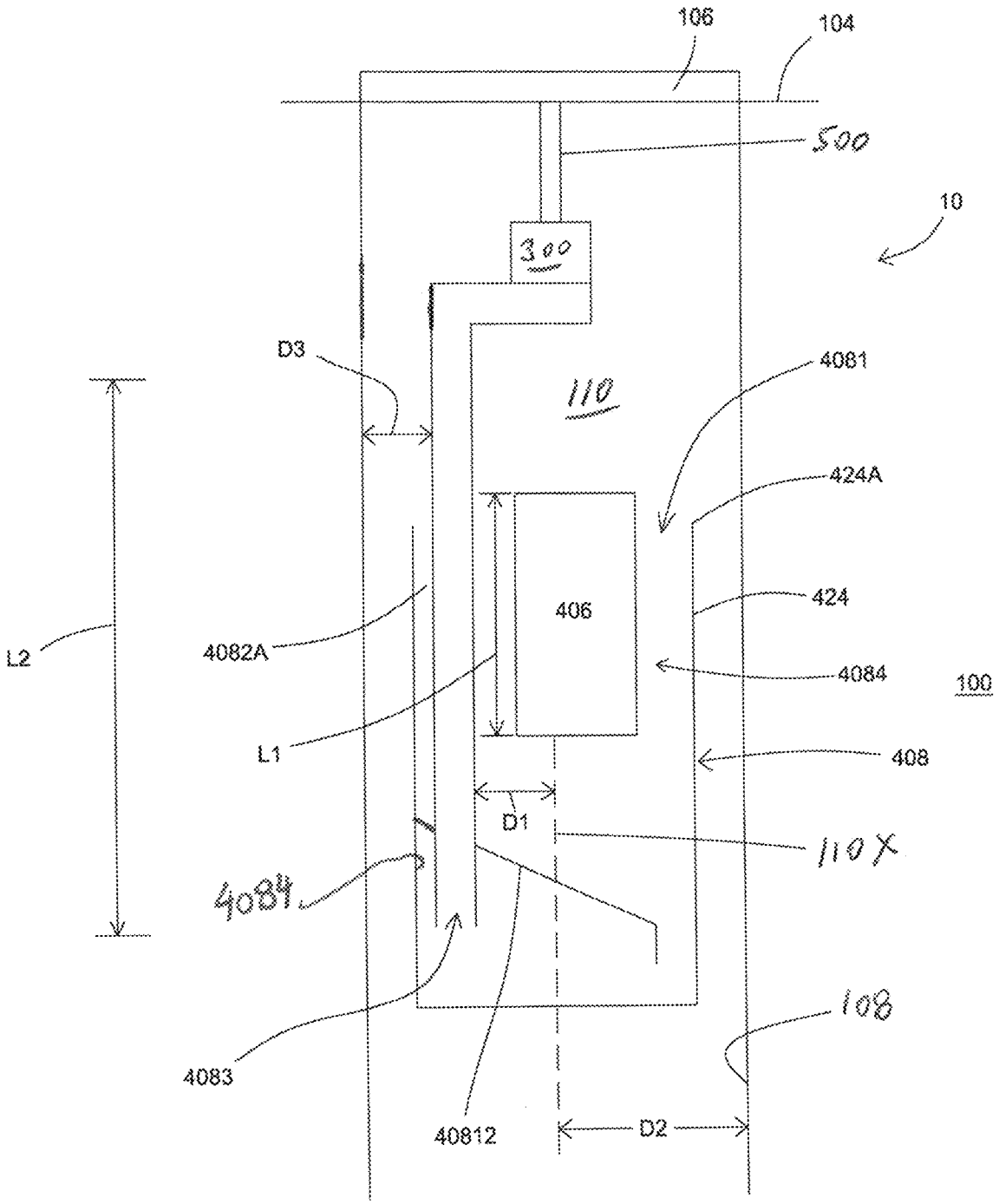
FIG. 7 is identical to the embodiment illustrated in FIG. 1, and identifying features relating to the positioning of the pump supplying flow conductor relative to the separation zone.

Referring to FIG. 7, to mitigate such interference, in some embodiments, for example, the gas-depleted reservoir fluid flow conductor 4082 includes an eccentrically-disposed portion 4082A, and at least a portion of the eccentrically-disposed portion 4082A is disposed adjacent to at least a portion of the gas separation zone 406. In some embodiments, for example, the entirety of the gas separation zone 406 is disposed adjacent to the eccentrically-disposed portion 4082A.

In some embodiments, for example, the at least a portion of the gas separation zone 406, disposed adjacent to the eccentrically-disposed portion 4082A, has a total length "L1" of at least six (6) inches, as measured along an axis that is parallel to the central longitudinal axis 110X of the wellbore string passage 110.

In some embodiments, for example, the eccentrically-disposed portion 4082A has a total length "L2" of at least six (6) feet, as measured along the central longitudinal axis 4082AX of the eccentrically-disposed portion 4082A. In some embodiments, for example, the eccentrically-disposed portion 4082A has a total length of at least 15 feet, as measured along the central longitudinal axis 4082AX of the eccentrically-disposed portion 4082A.

The eccentrically-disposed portion 4082A is disposed eccentrically relative to the central longitudinal axis 110X of the wellbore string passage 110. In some embodiments, for example, the ratio of (i) the minimum distance "D1" between the eccentrically-disposed portion 4082A and the central longitudinal axis 110X of the wellbore string passage 110 to (ii) the minimum distance "D2" between the wellbore string 108 and the central longitudinal axis 110X of the wellbore string passage 110 is greater than 1.2:1. In some embodiments, for example, the eccentrically-disposed portion 4082A is spaced-apart from the wellbore string 108 by a maximum distance "D3" of less than 0.75 inches, such as, for example, less than 0.5 inches, such as, for example, less than 0.25 inches.

Referring to FIG. 4, in some embodiments, for example, the eccentrically-disposed portion 4082A has a cross-sectional profile that is non-circular (e.g. oval-shaped). Configuring the eccentrically-disposed portion 4082A, such that its cross-sectional profile is non-circular, further mitigates interference with the separation, within the gas separation zone 406, of the reservoir fluid into the gas-depleted reservoir fluid and the gas-enriched reservoir fluid, by the gas-depleted reservoir fluid flow conductor 4082, and this is more pronounced where the cross-sectional profile of the eccentrically-disposed portion 4082A is oval-shaped and the cross-sectional profile of the wellbore string section, traversed by the eccentrically-disposed portion 4082A, is circular.

Figure 8:
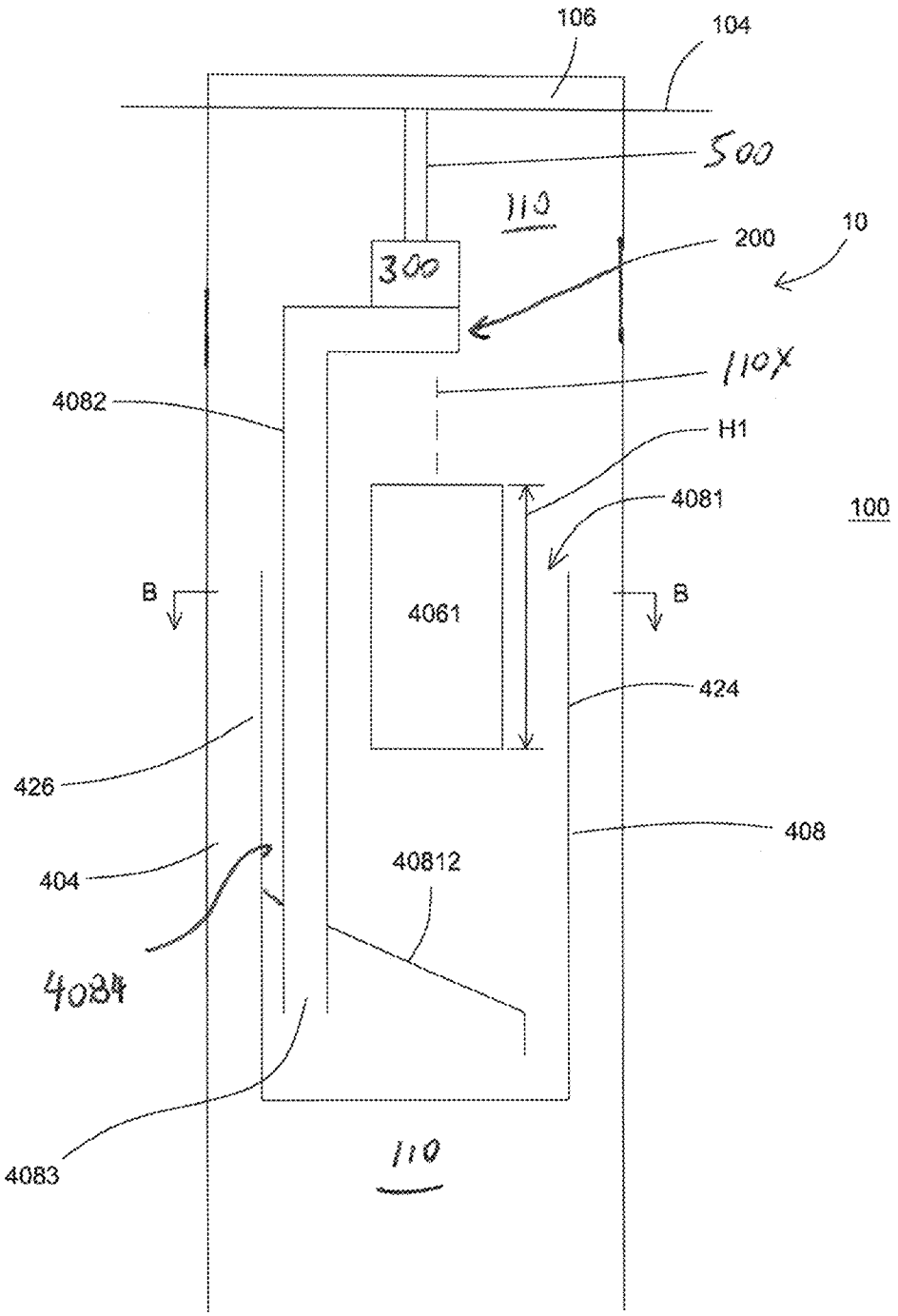
FIG. 8 is identical to the embodiment illustrated in FIG. 1, and illustrating the magnitude of the separation zone.
Figure 9:
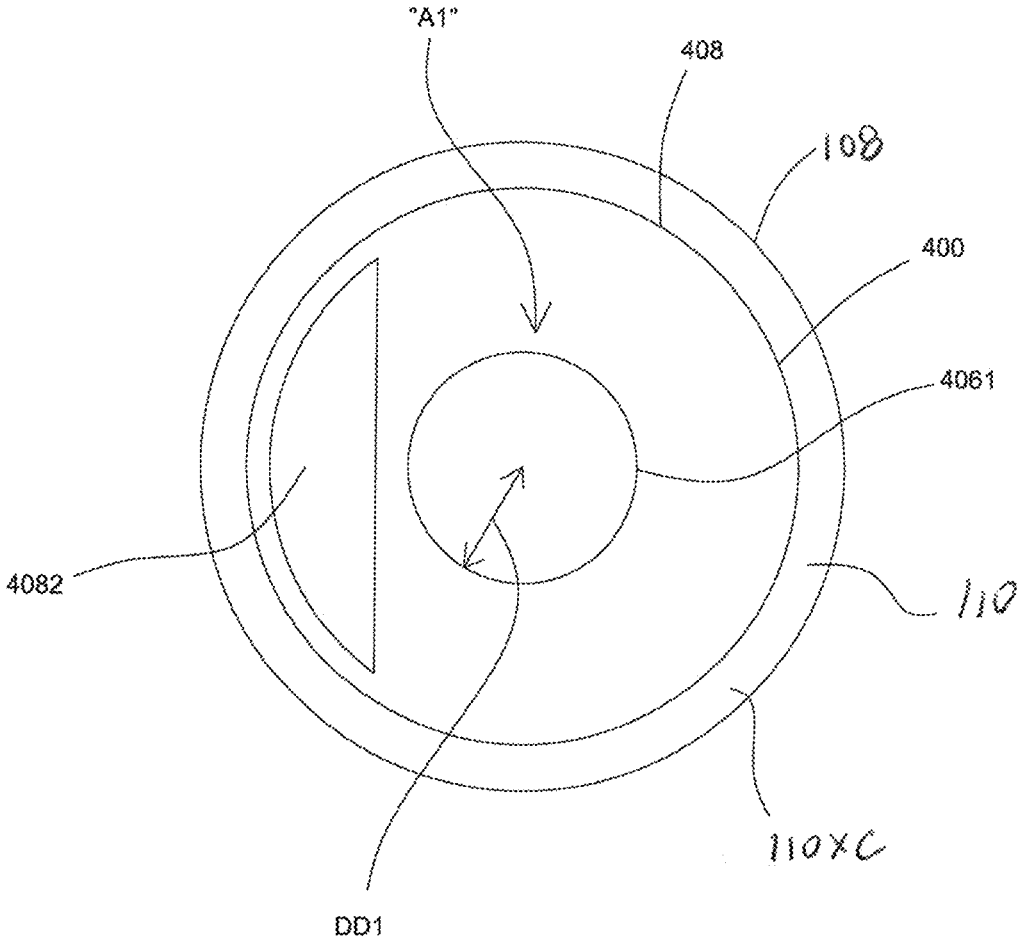
FIG. 9 is a schematic illustration of a sectional view of the embodiment illustrated in FIG. 8, taken along lines B-B.

Referring to FIGS. 8 and 9, in some embodiments, for example, the wellbore string 108 and the separator 400 are further co-operatively configured such that the gas separation zone 406 includes a cylindrical uninterrupted space 4061. In some embodiments, for example, the central longitudinal axis 110X of wellbore string passage 110 extends through the cylindrical uninterrupted space 4061.

Referring to FIG. 9, in some embodiments, for example, the wellbore string passage 110 includes a cross-section 110XC that is traversed by both of the cylindrical uninterrupted space 4061 and the gas-depleted reservoir fluid flow conductor 4082, and the area "A1", of the cross-section 110XC of the wellbore string passage 110, occupied by the cylindrical uninterrupted space 4061, defines at least 70% (such as, for example, at least 80%) of the total cross-sectional area of the cross-section 110XC of the wellbore string passage 110. In some of these embodiments, for example, for every one of the cross-sections of the wellbore string passage 108 that is traversed by both of the cylindrical uninterrupted space 4061 and the gas-depleted reservoir fluid flow conductor 4082, independently, the area, of the cross-section of the wellbore string passage 110, occupied by the cylindrical uninterrupted space 4061, defines at least 70% (such as, for example, at least 80%) of the total cross-sectional area of the cross-section of the wellbore string passage 110.

Referring to FIGS. 8 and 9, in some embodiments, for example, the cylindrical uninterrupted space 4061 has a diameter "DD1" of at least one (1) inch (such as, for example, at least 1.5 inches, such as, for example, at least two (2) inches) and a height "H1" of at least one (1) foot (such as, for example, at least two (2) feet, such as, for example, at least three (3) feet, such as, for example, at least four (4) feet, such as, for example, at least five (5) feet, such as, for example, at least six (6) feet).

Figure 10:
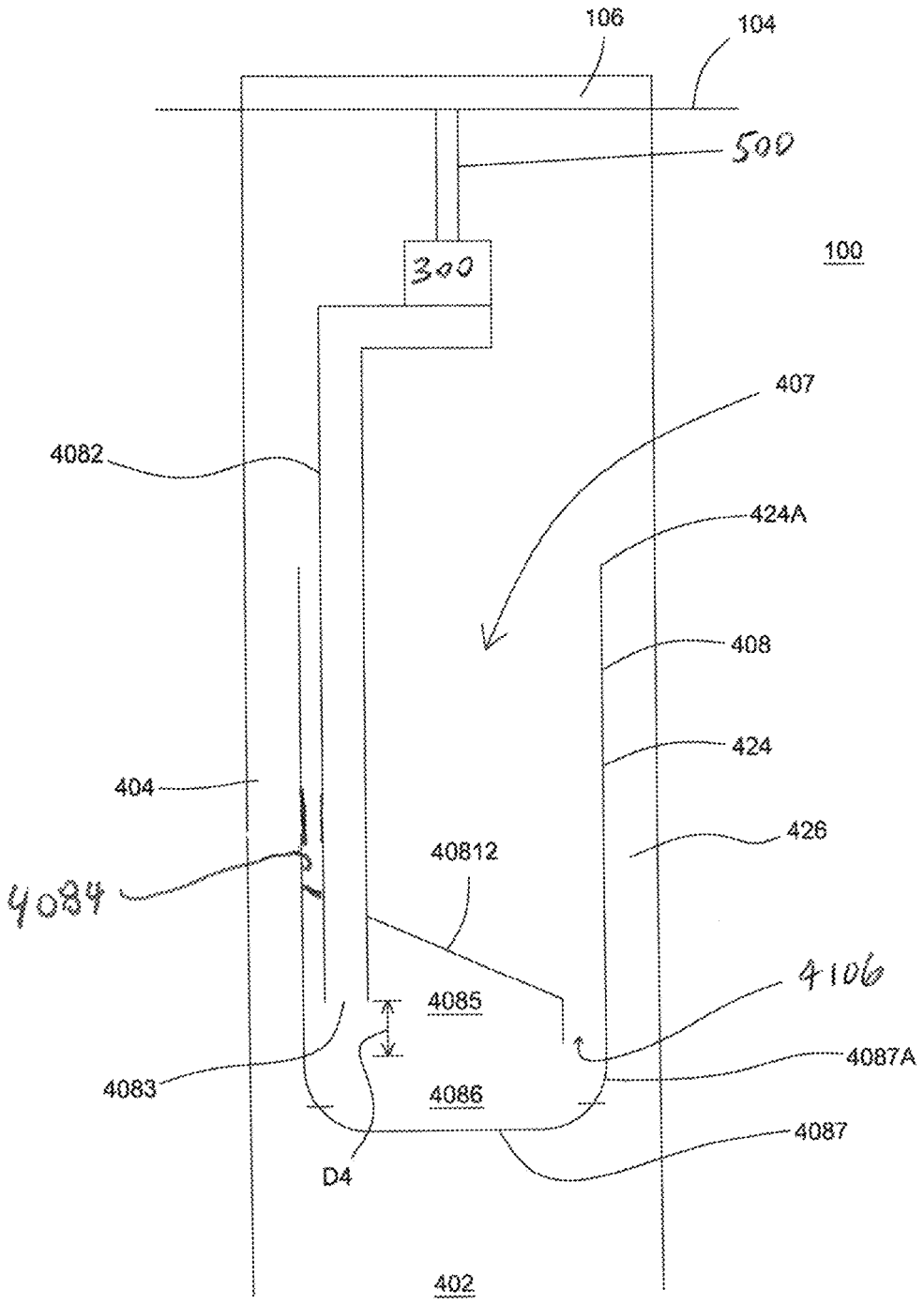
FIG. 10 is identical to the embodiment illustrated in FIG. 1, and identifying features relating to solids removal functionality of the system.
Figure 11:
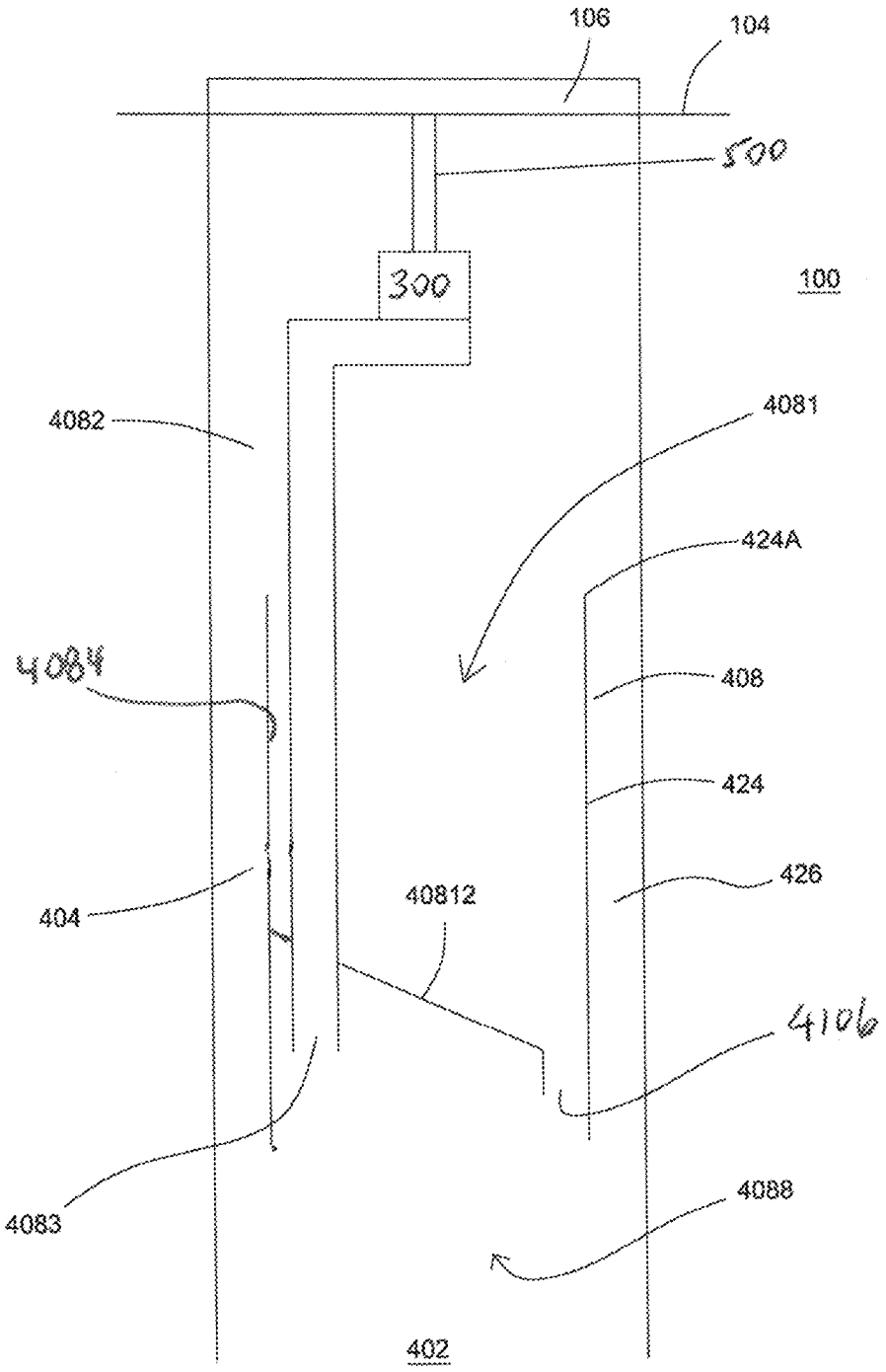
FIG. 11 is identical to the embodiment illustrated in FIG. 1, with the solids accumulation zone closure having been removed.

Referring to FIGS. 10 and 11, in some embodiments, for example, a solid separation-ready reservoir fluid-derived flow 412, derived from the reservoir fluid-derived flow 411, is discharged from the flow conductor 430 into a solids settling zone 4085, for encouraging separation of solids, entrained within the solid separation-ready reservoir fluid-derived flow 412, from the solid separation-ready reservoir fluid-derived flow 412. In some embodiments, for example, the discharging is via a flow discharging communicator 4106 of the flow conductor 430. In some embodiments, for example, the settling zone 4085 is defined within the housing 401.

In some embodiments, for example, the solids settling zone 4085 is co-located with the gas separation zone 406.

In some embodiments, for example, the flow diverter 408 further defines a solids accumulation zone 4086 for receiving solid material 900, which has separated from the solid separation-ready reservoir fluid-derived flow 412 within the solids settling zone 4085. In this respect, in some embodiments, for example, the solids accumulation zone 4086 is disposed below the solids settling zone and also, therefore the flow receiving communicator 4083 of the gas-depleted reservoir fluid conductor 4082. In some embodiments, for example, the solids settling zone 4085 and the solids accumulation zone 4086 are defined within the housing 401 of the separator 400.

Co-operatively, the discharging of the solid separation-ready reservoir fluid-derived flow 412, via the flow discharging communicator 4106, is with effect that the solid separation-ready reservoir fluid-derived flow 412 is directed downwardly from the flow discharging communicator 4106, and then changes direction, with effect that the solid separation-ready reservoir fluid-derived flow 412 is conducted upwardly towards the flow receiving communicator 4083. This change in direction of the flow of the solid separation-ready reservoir fluid-derived flow 412 promotes separation of the solid material 900 from the solid separation-ready reservoir fluid-derived flow 412, such that there is obtained a downwardly-displaced reservoir fluid-derived flow 413, derived from the solid separation-ready reservoir fluid-derived flow 412, and depleted in solids relative to the solid separation-ready reservoir fluid-derived flow 412. In this respect, in some embodiments, for example, the flow discharging communicator 4106 is disposed below the flow receiver 4083 by a distance "D4", measured along an axis that is parallel to a central longitudinal axis 108X of the wellbore string passage 108, of at least one (1) millimetre.

In some embodiments, for example, the flow discharging communicator 4106 is spaced apart from the flow receiving communicator 4083 of the gas-depleted reservoir fluid flow conductor 4082 by a distance sufficient to provide sufficient time for any solids, entrained within the solid separation-ready reservoir fluid-derived flow 412, to separate in response to gravity separation within the solids settling zone 4085, with effect that the separated solid material 900 accumulates within the solids accumulation zone 4088, and solids entrainment, within the gas-depleted reservoir fluid flow being conducted to the pump 300, is mitigated. In some embodiments, for example, the flow discharging communicator 4106 is disposed adjacent to a side of the flow diverter 408 that is opposite to the side of the flow diverter 408 to which the flow receiving communicator 4083 is adjacent. In some embodiments, for example, the distance of the closest flowpath "FP" between the flow discharging communicator 4106 and the flow receiving communicator 4083 of the gas-depleted reservoir fluid flow conductor 4082 is greater than two (2) inches, such as, for example, greater than four (4) inches, such as, for example, greater than six (6) inches.

In some embodiments, for example, the housing 401 includes a removable solids accumulation zone closure 4087. In response to opening (e.g. removal) of the closure 4087, communication with the solids accumulation zone is established externally of the housing 401 via a solids accumulation zone communicator 4088 (e.g. an aperture), such that accumulated solids within the solids accumulation zone 4086 are removable through the solids accumulation zone communicator 4088 (see FIG. 11). In this respect, in some embodiments, for example, the housing 401 further includes a closure receiving counterpart 4087A for releasable coupling to the closure 4087, such that the closure 4087 is releasably coupled to the closure receiving counterpart 4087A, and is thereby removable from the closure receiving counterpart 4087A. In some embodiments, for example, the releasable coupling is a threaded coupling. In some embodiments, for example, the closure 4087 defines a solids collector for collecting and containing the accumulated solids. In some embodiments, for example, the solids collector is interchangeable with another solids collector with a different capacity for collecting and containing the accumulated solids, to better match the contemplated solids management requirements.

In order to define a sufficiently large flow receiving communicator 4081 (to promote separation of the gas-depleted reservoir fluid flow from the gas-enriched reservoir fluid flow), while positioning the flow discharging communicator 4106 so establish the sufficiently long flowpath "FP", as above-described, the flow receiving communicator 4081 and the flow discharging communicator 4106 are co-operatively configured such that the cross-sectional flow area of the flow receiving communicator 4081 is larger than the cross-sectional flow area of flow discharging communicator 4106. In some embodiments, for example, the ratio of the cross-sectional flow area, defined by the flow receiving communicator 4081 of the flow diverter 408, to the cross-sectional flow area defined by the flow discharging communicator 4106 is at least three (3), such as, for example, at least five (5), such as, for example, at least ten (10), such as, for example, at least 20. In some embodiments, for example, the cross-sectional flow area defined by the flow discharging communicator 4106 is at least 0.196 square inches, such as, for example, at least 0.785 square inches.

Figure 12:
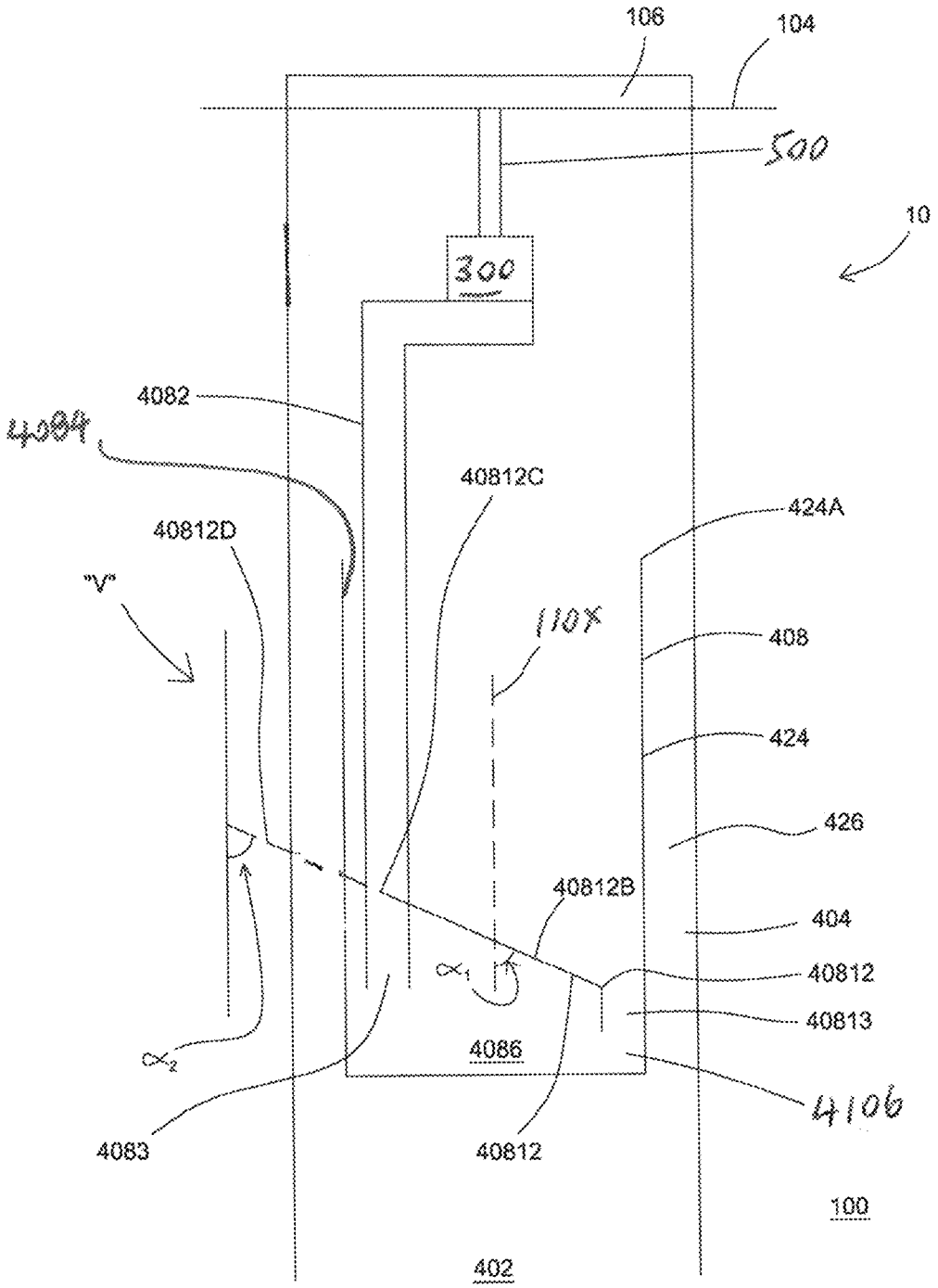
FIGS. 12 and 13 are identical to the embodiment illustrated in FIG. 1, and identifying further features relating to solids removal functionality of the system.
Figure 13:
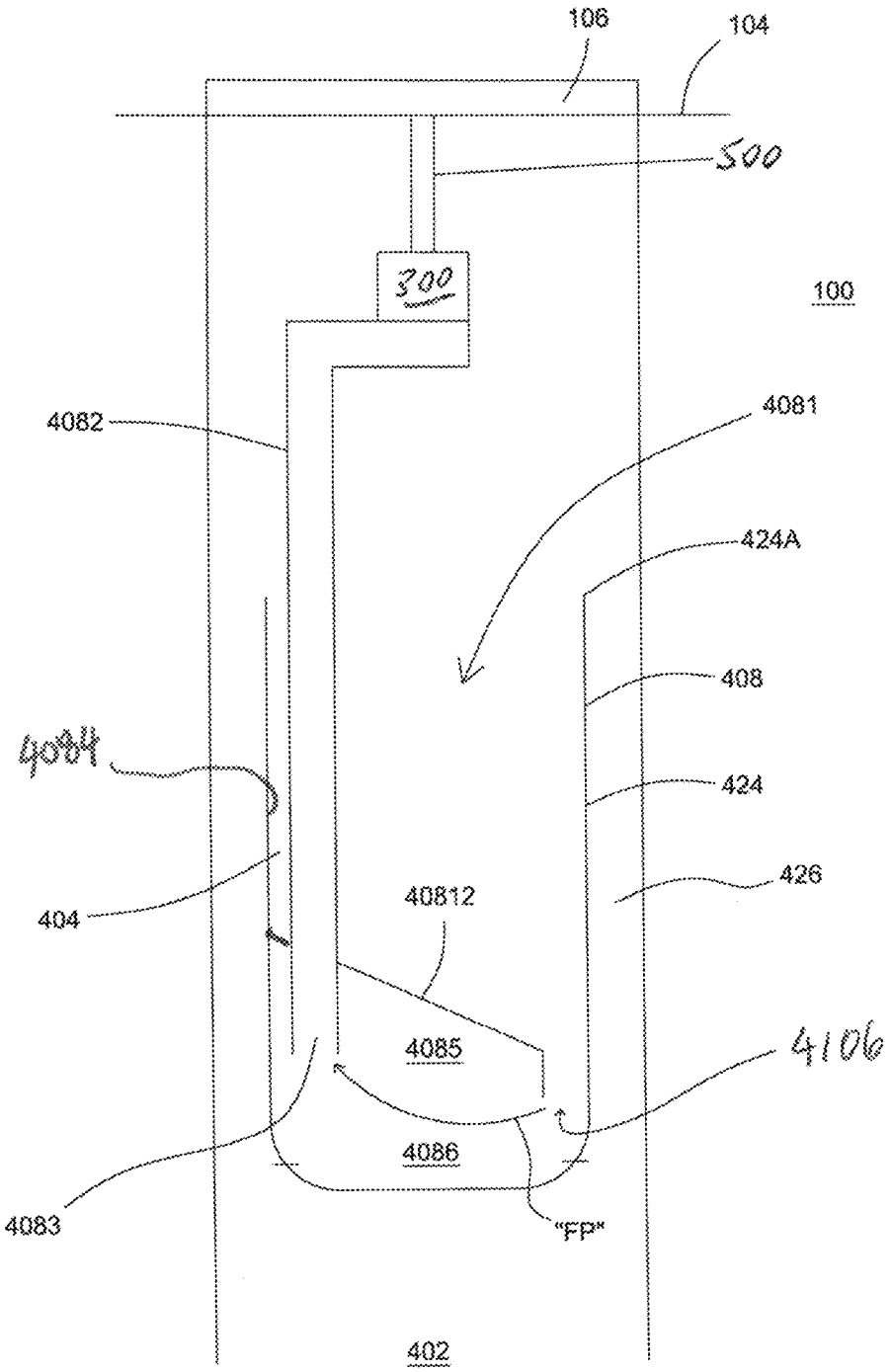

This co-operative configuration (between the flow receiving communicator 4081 and the flow discharging communicator 4106) is particularly suitable for, amongst other embodiments, those embodiments where the separator has a cylindrical portion, open at a first end 434, for defining the flow receiving communicator 4081, and closed at a second opposite end 436, for co-operating with the flow receiver 4083 to effectuate the diverting of the flow of the diverting-ready reservoir fluid-derived flow 413. Referring to FIGS. 12 and 13, in some of these embodiments, for example, the flow diverter 408 includes a baffle 40812, extending from an interior wall 4084 of the housing 401 of the separator 400, for directing the downwardly-flowing reservoir fluid-derived fluid towards a solids settling zone flow conductor portion 4104, prior to its receiving by the flow receiver 4083 of the gas-depleted reservoir fluid flow conductor 4082. The settling zone-directed flow conductor portion 4104 has an uphole end and a downhole end, wherein the uphole end is disposed above the downhole end, and the downhole end defines the flow discharging communicator 4106. In some embodiments, for example, while the separator 400 is emplaced within the wellbore, the central longitudinal axis of the settling zone-directed flow conductor portion 4104 is disposed along the vertical axis. In this respect, the baffle 40812 is disposed between the flow receiving communicator 4081 and the flow receiver 4083 of the gas-depleted reservoir fluid flow conductor 4082, and includes a terminal end 40812A that leads into the settling zone-directed flow conductor portion 4104. In this respect, flow communication between the flow receiving communicator 4081 and the flow receiver 4083 is effectuated via the settling zone-directed flow conductor portion 4104. In some embodiments, for example, the settling zone-directed flow conductor portion 4104 is defined by a dip tube 40813, extending downwardly from the baffle 40812. In some embodiments, for example, the gas-depleted reservoir fluid flow conductor 4082 extends through the baffle 40812.

In some embodiments, for example, the baffle 40812 extends in a downwardly direction, towards the settling zone-directed flow conductor portion 4104, and defines an uphole-facing surface 40812B which is oriented for encouraging downwardly movement of solid material (which, in some operational implementations, has separated from the downwardly-flowing reservoir fluid-derived fluid) towards the settling zone-directed flow conductor portion 4104. In some embodiments, for example, an axis 40812C, disposed parallel to the uphole-facing surface 40812B, is disposed at an acute angle "a1", relative to the central longitudinal axis 108X of the wellbore string passage 108, that is less than 70 degrees. In some embodiments, for example, an axis 40812DC, disposed parallel to the uphole-facing surface 4022B, is disposed at an acute angle "a2", relative to the vertical "V", that is less than 70 degrees.

Figure 17:
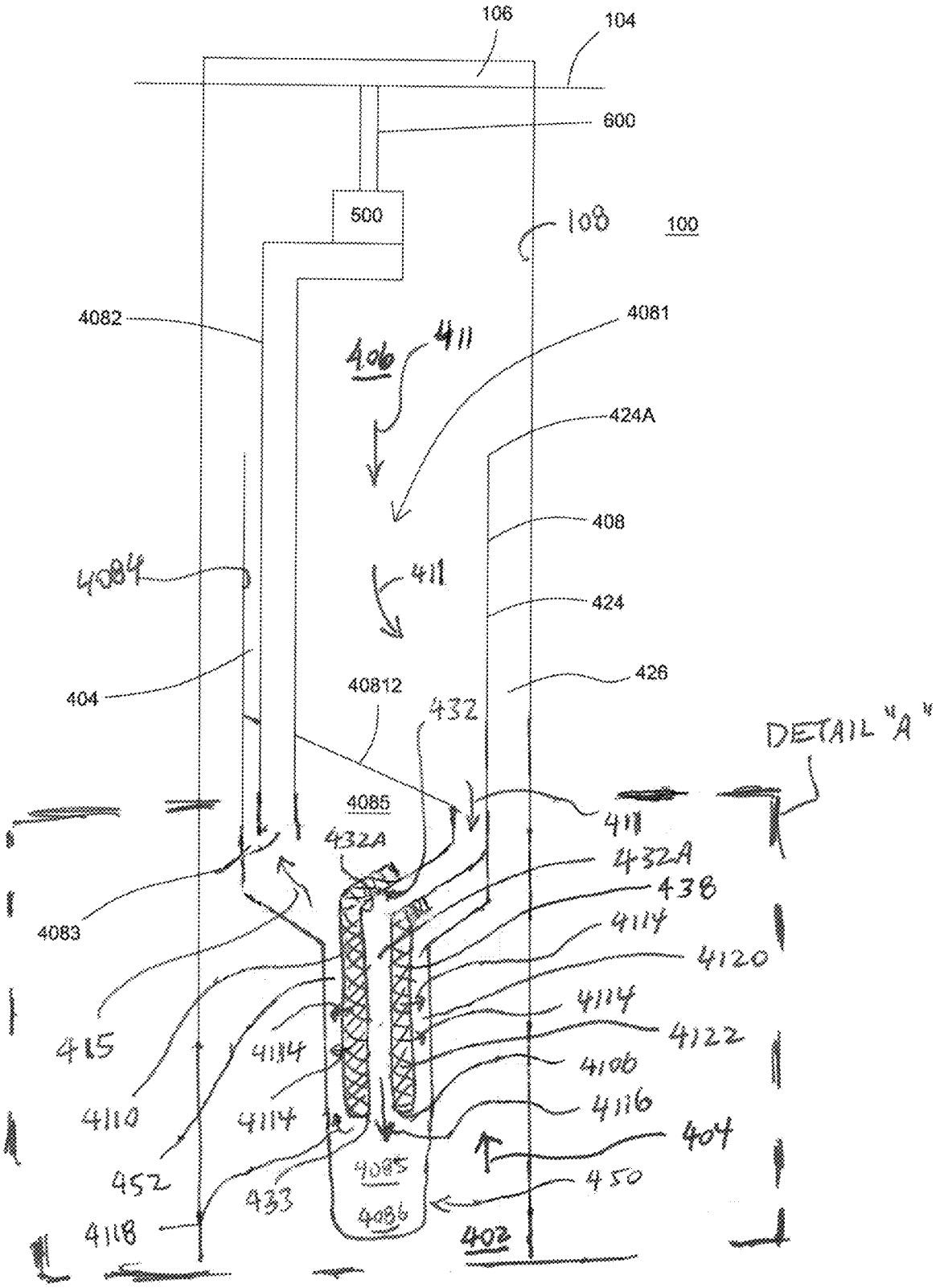
FIG. 17 is a schematic illustration of another embodiment of the present disclosure.

Referring to FIGS. 17 and 18, in some embodiments, for example, the flow conductor 430 further includes a filter-communicating flow conductor portion 432 and a solids filtering apparatus 4110. In some embodiments, for example, the filter-communicating flow conductor portion 432 is defined by the settling zone-directed flow conductor portion 4104.

The solids filtering apparatus 4110 is configured for fractionating the reservoir fluid-derived flow 411 into at least a first solids-depleted reservoir fluid-derived flow 4114 and a solids-enriched reservoir fluid-derived flow 4116. The first solids-depleted reservoir fluid-derived flow 4114 has a lower content of solid material relative to the reservoir fluid-derived flow 411. The solids-enriched reservoir fluid-derived flow 4116 has a higher content of solid material relative to the reservoir fluid-derived flow 411. The solid separation-ready reservoir fluid-derived flow 412 is derived from the solids-enriched reservoir fluid-derived flow 4116. In some embodiments, for example, the solid separation-ready reservoir fluid-derived flow 412 is defined by the solids-enriched reservoir fluid-derived flow 4116, and, in this respect, the solids-enriched reservoir fluid-derived flow 4116 is discharged into the solids settling zone 4085 via the flow discharging communicator 4106 (e.g. which in these embodiments, for example, functions as a retentate discharging communicator).

The obtained solids-enriched reservoir fluid-derived flow 4116 has a slower flowrate than the reservoir fluid-derived flow 411, which improves the efficiency of gravity separation of solid material from the solid separation-ready reservoir fluid-derived flow 412 (which, in some embodiments, for example, and as explained above, is defined by the solids-enriched reservoir fluid-derived flow 4116).

The filter-communicating flow conductor portion 432 and the solids filtering apparatus 4110 are co-operatively configured such that, while the reservoir fluid-derived flow 411 is being received by the flow receiving communicator 4081 and conducted by the flow conductor 430, with effect that the reservoir fluid-derived flow becomes emplaced within the filter communicating flow conductor portion 432, in response to the emplacement of the reservoir fluid-derived flow within the filter communicating flow conductor portion 432:

the reservoir fluid-derived fluid flow 411 becomes disposed in mass transfer communication apparatus with the solids filtering apparatus 4110, with effect that the reservoir fluid-derived flow 411 is fractionated into at least the first solids-depleted flow 4114 and the solids-enriched flow 4116, with effect that: (i) the first solids-depleted flow 4114 is discharged from the flow conductor 430 via a permeate discharging communicator 438, disposed below the uphole wellbore zone 405, into a filtered flow receiving zone 4120, (ii) the solids-enriched flow 4116, is discharged from the flow conductor 430 via the flow discharging communicator 4106, disposed below the uphole wellbore zone 405, with effect that the solids-enriched flow 4116 becomes emplaced in the solids settling zone 4085. In some embodiments, for example, the filtered flow receiving zone 4120 is disposed within the housing 401.

In those embodiments where the reservoir fluid-derived flow 411 is a downwardly-flowing reservoir fluid-derived flow 411, in some of these embodiments, for example, the solids-enriched flow 4116 is a downwardly-flowing the solids-enriched flow 4116.

While disposed in the solids settling zone 4085, the solid separation-ready flow 412 becomes depleted in solid material in response to gravity separation such that a second solids-depleted flow 4118 is obtained, and the first solids-depleted flow 4114 and the second solids-depleted flow 4118 combine to define the downwardly-displaced reservoir fluid-derived flow 413.

Each one of the solids settling zone 4085 and the filtered flow receiving zone 4120, independently, is disposed in flow communication with the flow receiver 4083 of the gas-depleted reservoir fluid flow conductor 4082, with effect that the combination of the solids-depleted flow 4118 and the solids-depleted flow 4114 is effectuated, with effect that the downwardly-displaced reservoir fluid-derived flow 413 is produced within the flow diverter 408 (and also the housing 401), and with additional effect that the gas-depleted reservoir fluid flow 415, deriving from the downwardly-displaced reservoir fluid-derived flow 413, is also produced within the flow diverter 408 (and also the housing 401). The produced gas-depleted reservoir fluid flow 415 is then diverted by the flow diverter 408 such that the upwardly flowing gas-depleted reservoir fluid 415 is obtained for conducting by the gas-depleted reservoir fluid flow conductor 4082. In this respect, in some embodiments, for example, the gas-depleted reservoir fluid flow conductor 4082, the permeate discharging communicator 438, and the flow discharging communicator 4106 are co-operatively configured such that, the gas-depleted reservoir fluid flow conductor 4082 is disposed for conducting the upwardly-flowing gas-depleted reservoir fluid 415 which is derived from the downwardly-displaced reservoir fluid flow 413. In some embodiments, for example, the permeate discharging communicator 438 is disposed above the flow discharging communicator 4106 so as to mitigate interference, by the first solids-depleted flow 4114, to the gravity separation of solid material from the solid separation-ready flow 412 in the solids settling zone 4085.

In some embodiments, for example, the solids filtering apparatus 4110 includes a filtering medium 4122 (e.g. for mechanical filtering). The filtering medium 4122 is configured for preventing oversize solid material from being conducted, via the permeate discharging communicator 438, from the filtering medium-communication effecting flow passage 432B to the filtered flow receiving zone 4120. The fractionation of the reservoir fluid-derived flow 411, into at least the first solids-depleted flow 4114 and the solids-enriched flow 4116, is based upon the preventing of the conduction of the oversize material, from the filtering medium-communication effecting flow passage 432B to the filtered flow filtered fluid receiving zone 412, by the filtering medium 4122.

In some embodiments, for example, the filter-communicating flow conductor portion 432 and the filtering medium 4122 are co-operatively configured such that the mass transfer communication between the reservoir fluid-derived flow 411 and the solids filtering apparatus 4110 is established as the reservoir fluid-derived flow 411 is being conducted in cross-flow orientation relative to the filtering medium 4122.

In those embodiments where the solids filtering apparatus 4110 includes the filtering medium 4122, in some of these embodiments, for example, the filter communicating flow conductor portion 432 defines a filtering medium-traversing portion 432A, and the filtering medium traversing portion 432A defines a filtering medium-communication effecting flow passage 432B through which the reservoir fluid-derived flow 411 is flowing while the reservoir fluid-derived fluid flow 411 is disposed in mass transfer communication with the filtering medium 4122. The filtering medium-communication effecting flow passage 432B co-operates with the reservoir fluid-derived flow 411 such that flowing of the reservoir fluid-derived flow 411, through the filtering medium-traversing portion 432A, is with effect that the reservoir fluid-derived flow 411 traverses the filtering medium 4122.

In some embodiments, for example, the filtering medium 4122 is configured for preventing oversize solid material from being conducted, via the permeate discharging communicator 438, from the filtering medium-communication effecting flow passage 432B to the filtered flow receiving zone 4120. The fractionation of the reservoir fluid-derived flow 411, into at least the first solids-depleted flow 4114 and the solids-enriched flow 4116, is based upon the preventing of the conduction of the oversize material, from the filtering medium-communication effecting flow passage 432B to the filtered flow filtered fluid receiving zone 412, by the filtering medium 4122.

In some embodiments, for example, the flow conductor 430 defines a solids flow-encouraging conductor portion 433 for encouraging downwardly displacement of solid material, deriving from the reservoir fluid-derived flow 411, by gravity, towards the solids settling zone 4085. In this respect, in some embodiments, for example, the solids flow-encouraging conductor portion 433 and the filtering medium 4122 are co-operatively configured such that the mass transfer communication between the reservoir fluid-derived flow 411 and the filtering medium 4122 is established as the reservoir fluid-derived flow 411 is being conducted in a downwardly direction by the flow conductor 430, and such that the solids-enriched flow 4116 is conducted downwardly, from the filter communicating flow conductor portion 432 to the flow discharging communicator 4106. In some embodiments, for example, the solids flow-encouraging conductor portion 433 extends uphole from the flow discharging communicator 4106, and includes the filter communicating flow conductor portion 432. In this respect, the flow discharging communicator 4106 is disposed below the permeate discharging communicator 438. The solids flow-encouraging conductor portion 433 defines a fluid passage 433A whose central longitudinal axis 433X is disposed at an acute angle of less than 45 degrees from the vertical axis.

In some of these embodiments, for example, the filtering medium-communication effecting flow passage 432B has an axial length of at least five (5) feet. In some embodiments, for example, the filtering medium-communication effecting flow passage 432B has a total volume "V1", and the filtering medium 4122, traversed by the conducting of the reservoir fluid-derived flow 411, has a total surface area "A1", and the ratio of the total surface area "A1" to the total volume "V1" is at least 0.013.

In some embodiments, for example, the filtering medium 4122 is a screen. In some embodiments, for example, the filtering medium 4122 is a corrugated screen. In some embodiments, for example, the filtering medium 4122 is vertically oriented while the separator 400 is disposed within the wellbore passage.

In some embodiments, for example, the top (or bottom) plan profile of the filtering medium 4122 is in the form of a six-pointed star.

Referring to FIGS. 17, 18A, 18B, 18C, and 18D, in some embodiments, for example, the solids flow-encouraging conductor portion 433, including the filtering medium-traversing portion 432A, extends into a mud joint 450 that defines a bottom portion of the housing 401 of the separator 400. In this respect, the flows 4114 and 4118 combine within an annular space 452 within the mud joint 450 to produce the downwardly-displaced reservoir fluid-derived flow 413. The annular space 452 is defined between the solids filtering apparatus 4110 and an internal wall of the mud joint 450. The gas-depleted reservoir fluid 415 derives from the downwardly-displaced reservoir fluid-derived flow 413, and is conducted uphole to the pump 300 via the flow receiving communicator 4083.

In some embodiments, for example, the mud joint 450 and the filtering medium-traversing portion 432A are co-operatively configured such that the cross-sectional area of the mud joint 450 is effectively used for providing sufficient flow area through the permeate discharging communicator 438 (conduction of oversize material through which the filtering medium 4122 is configured for preventing), for optimizing the rate of flow of the first solids-depleted flow 4114, without unacceptably compromising available cross-sectional flow area of the annular space 452. In some embodiments, for example, separation efficiency is compromised where the cross-sectional flow area of the annular space 452 is unacceptably small. Where the cross-sectional flow area of the annular space 452 is unacceptably small, in some embodiments, for example, gaseous material may be liberated from one or both of the flows 4114, 4118, so as to unnecessarily introduce gaseous material to the gas-depleted reservoir fluid 415. Also, where the cross-sectional flow area of the annular space 452 is unacceptably small, in some embodiments, for example, solid material may come out of solution and deposit within the separator 400, and thereby contribute to scaling. Further, where the cross-sectional flow area of the annular space 452 is unacceptably small, in some embodiments, for example, one or both of the flows 4114, 4418 may suffer sufficient dynamic pressure losses so as to be detrimental to the separation occurring uphole within the separation zone.

In this respect, in some embodiments, for example, the mud joint 450 and the filtering medium-traversing portion 432A are co-operatively configured such that, within a cross-section of the mud joint 450, a minimum ratio, of the cross-sectional flow area of the annular space 452 to the cross-sectional flow area of the filtering medium-communication effecting flow passage 432B, is defined, and the minimum ratio is at least 1.0, such as, for example, at least 1.2.

In some embodiments, for example, the filtering medium 4122 is metallic. In some embodiments, for example, the filtering medium 4122 is non-metallic.

In some embodiments, for example, the filtering medium 4122 has a coating that is characterized by low adhesion properties, such as, for example, a low static coefficient of friction and/or a low dynamic coefficient of friction.

In some embodiments, for example, the reservoir fluid-derived flow 411 includes oversize solid material, and the oversize solid material is characterized by a size of greater than 60 mesh, and the filtering medium 4122 prevents passage of at least 90% of the oversize solid material of the reservoir fluid-derived flow 411.

In some embodiments, for example, the reservoir fluid-derived flow 411 includes oversize solid material, and the oversize solid material is characterized by a size of from 100 mesh to 140 mesh, and the filtering medium 4122 prevents passage of at least 90% of the oversize solid material of the reservoir fluid-derived flow 411.

In some embodiments, for example, the filtering medium 4122 and the filter-communicating flow conductor portion 432 are co-operable with a reservoir fluid flow 411 such that, while the reservoir fluid-derived flow 411 is traversing the filtering medium 4122, at least a portion of the solid material, entrained within the reservoir fluid flow 411, is urged towards the filtering medium 4122, such that at least a fraction of the solid material, of the reservoir fluid-derived flow 411, accumulates adjacent to the filtering medium, such that accumulated solid material 900A becomes emplaced adjacent to the filtering medium 4122. In some embodiments, for example, the emplaced accumulated solid material 900A is maintained adjacent to the filtering medium 4122. In some embodiments, for example, the at least a portion of the accumulated solid material is adhered to the filtering medium 4122.

Figure 18A:
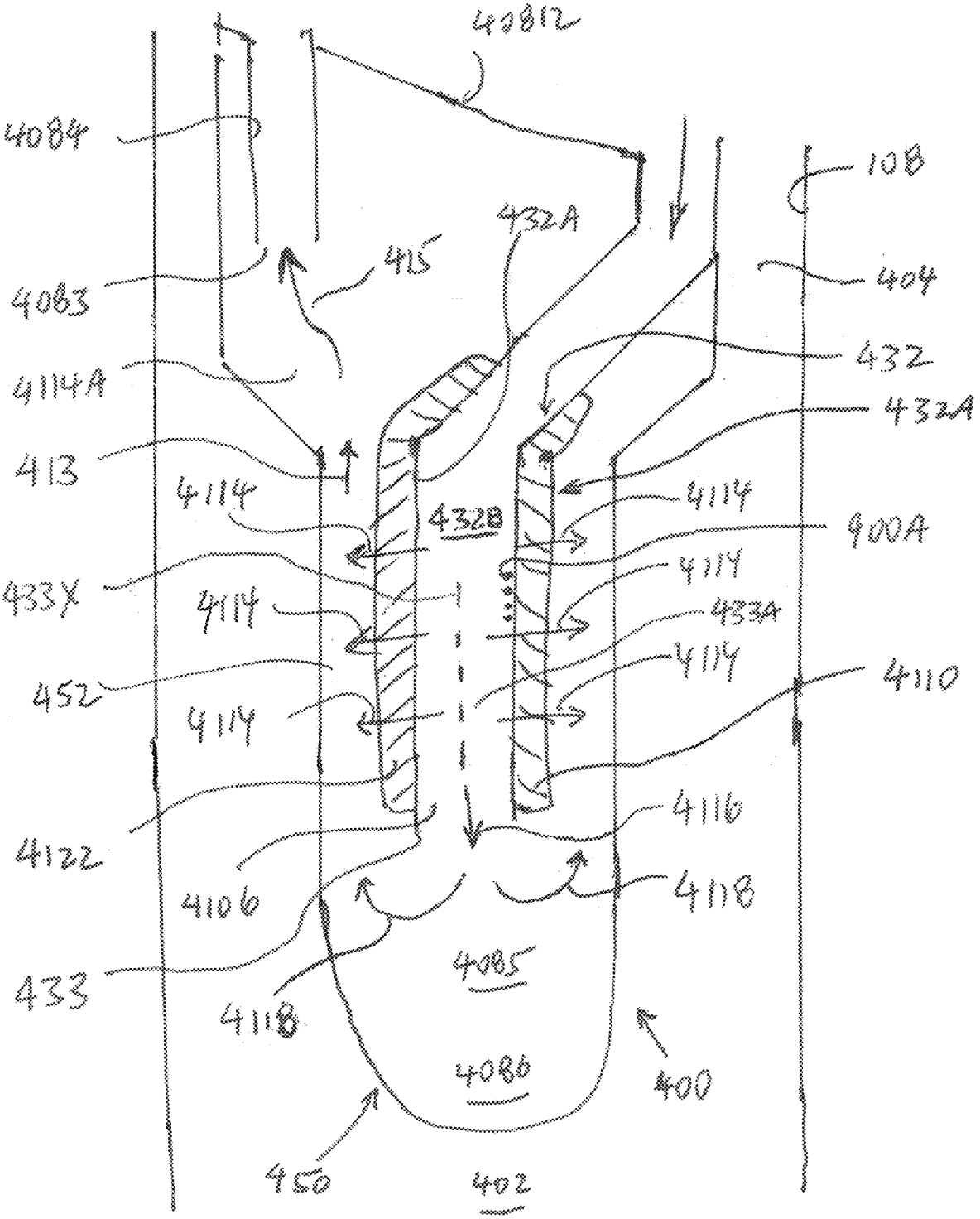
FIG. 18A is an enlarged portion of Detail "A" of the embodiment illustrated in FIG. 17, disposed in a first configuration.
Figure 18B:
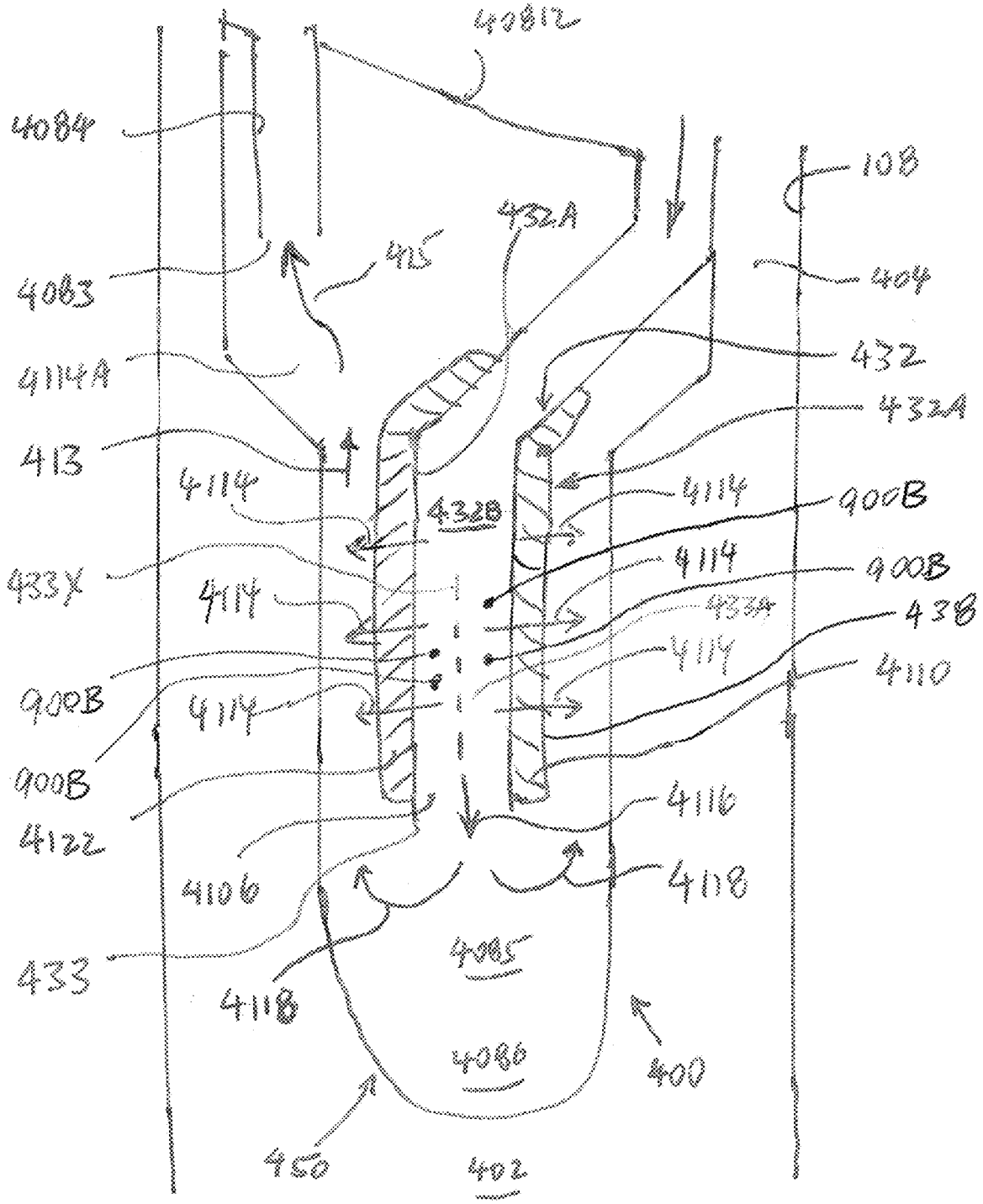
FIG. 18B is an enlarged portion of Detail "A" of the embodiment illustrated in FIG. 17, disposed in a second configuration.

Referring to FIGS. 18A and 18B, in some embodiments, for example, the rate of flow of the reservoir fluid-derived flow 411 is at least reduced, with effect that at least a fraction of the accumulated solid material 900A is conducted, in response to at least gravity, to the solid settling zone 4085 via the flow discharging communicator 4106. In those embodiments where the accumulated solid material 900A is adhered to the filtering medium 4122, in some of these embodiments, for example, prior to the conducting of the accumulated solid material to the solids settling zone, in response to the reduction in the rate of flow of the reservoir fluid-derived flow 411, the adhered solid material becomes released from the filtering medium 4122. In some embodiments, for example, the at least a reduction of the rate of flow, of the reservoir fluid-derived flow 411, is defined by a reduction in the rate of flow, such that the conduction of the at least a fraction of the accumulated solid material 900A, from the filtering medium-traversing portion 432A and to the solids settling zone 408, via the flow discharging communicator 4106, includes conduction effectuated by sweeping of the at least a fraction of the accumulated solid material 900A by the reduced-flow reservoir fluid-derived flow 411. In some embodiments, for example, the at least a reduction of the rate of flow, of the reservoir fluid-derived flow 411, is defined by a suspension of the flow of the reservoir fluid-derived flow 411.

In this respect, the system 10 is configurable in a first configuration (see FIG. 18A) for generating a reservoir fluid-derived flow 411, in an uphole direction, at a first rate of flow, and is also configurable in a second configuration (see FIG. 18B) for generating a reservoir fluid-derived flow 411, in an uphole direction, at a second rate of flow. The second rate of flow is less than the first rate of flow. In some embodiments, for example, the second rate of flow is less than 90% of the first rate of flow. The system 10 is transitionable from the first configuration to the second configuration.

While the system 10 is disposed in the first configuration, and the reservoir fluid-derived flow 411 is traversing the filtering medium 4122 at a first rate of flow, at least some of the solid material, entrained within the reservoir fluid flow 411 within the filtering medium-traversing portion 432A, is urged towards the filtering medium 4122, such that at least a fraction of the solid material, of the reservoir fluid flow 411, becomes deposited adjacent to the filtering medium, such that accumulated solid material 900A accumulates within the filtering medium-traversing portion 432A, adjacent to the filtering medium 4122.

Transitioning of the system 10 from the first configuration to the second configuration is with effect that the reduction in the rate of flow of the reservoir fluid-derived flow 411 is established, such that a reduced flow reservoir fluid-derived flow 411 becomes emplaced within the filtering medium-traversing portion 432A. In response the emplacement of the reduced flow reservoir fluid-derived flow 411 within the filtering medium-traversing portion 432A, the reduced flow reservoir fluid-derived fluid flow 411 becomes disposed in mass transfer communication apparatus with the filtering medium 4122, with effect that the reduced flow reservoir fluid-derived flow 411 is fractionated into at least a reduced flow first solids-depleted flow 4114 and a reduced flow solids-enriched flow 4116, with effect that: (i) the reduced flow first solids-depleted reservoir fluid-derived flow 4114 is discharged from the flow conductor 430 via the permeate discharging communicator 438, disposed below the uphole wellbore zone 405, into a filtered flow receiving zone 4120, (ii) a reduced flow solid separation-ready flow 412, derived from the reduced flow solids-enriched flow 4116, is discharged from the flow conductor 430 via the flow discharging communicator 4106, disposed below the uphole wellbore zone 405, with effect that the reduced flow solid separation-ready flow 412 becomes emplaced in the solids settling zone 4085. By virtue of the establishing of the reduced flow reservoir fluid-derived flow 411, at least a fraction of the accumulated solid material 900A is swept, by the reduced-flow solid separation-ready flow 412 from the filtering medium-traversing portion 432A and into the solids settling zone 4085 via the flow discharging communicator 4106, as dispersed solid material 900B.

In some embodiments, for example, the pump 300 of the system 10 is a rod pump. In some of these embodiments, for example, while the pump is disposed in the pump cavity-filling configuration (FIG. 20B), the conveyer 302 is being displaced in the uphole direction, and the conveyor 302 is disposed below its uphole displacement limit, such that the travelling valve 306 is closed and the standing valve 310 is open, the system 10 is disposed in the first configuration. Transitioning from the first configuration to the second configuration is effectuated in response to uphole displacement of the conveyor 302. In this respect, while the system 10 is disposed in the first configuration, uphole displacement of the conveyor 302 is with effect that the conveyor 302 becomes disposed closer to the uphole displacement limit, and the system 10 transitions to the second configuration.

In this respect, a method is also provided, and the method includes establishing the accumulated solid material 900A, adjacent to the filtering medium 4122 (such as, for example, while the system 10 is disposed in the first configuration, such as, for example, in those embodiments where the pump is a rod pump, while the pump is disposed in the pump cavity-filling configuration (FIG. 20B), the conveyer 302 is being displaced in the uphole direction, and the conveyor 302 is disposed below its uphole displacement limit), and, after the establishing of the accumulated solid material 900A, reducing the reservoir fluid-derived flow 411 (such as, for example, while the system 10 is disposed in the second configuration, such as, for example, in those embodiments where the pump is a rod pump, while the pump is disposed in the pump cavity-filling configuration (FIG. 20B) and the conveyer 302 has been further displaced in the uphole direction, closer to its uphole displacement limit), such that the accumulated solid material 900A is swept as dispersed solid material 900B from the filtering medium-traversing portion 432A and into the solids settling zone 4085 via the flow discharging communicator 4106.

Figure 18C:
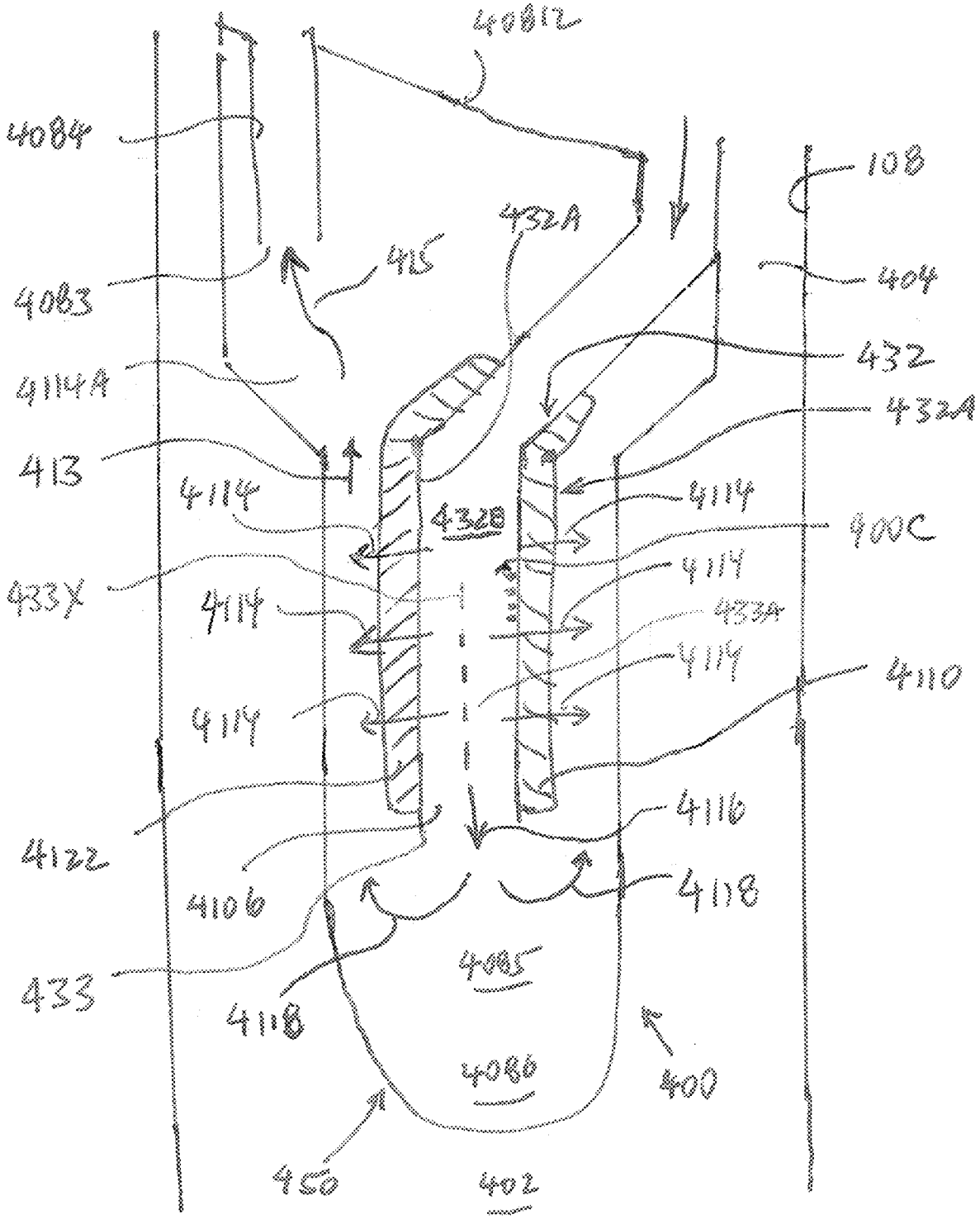
FIG. 18C is an enlarged portion of Detail "A" of the embodiment illustrated in FIG. 17, disposed in a production-effective configuration.
Figure 18D:
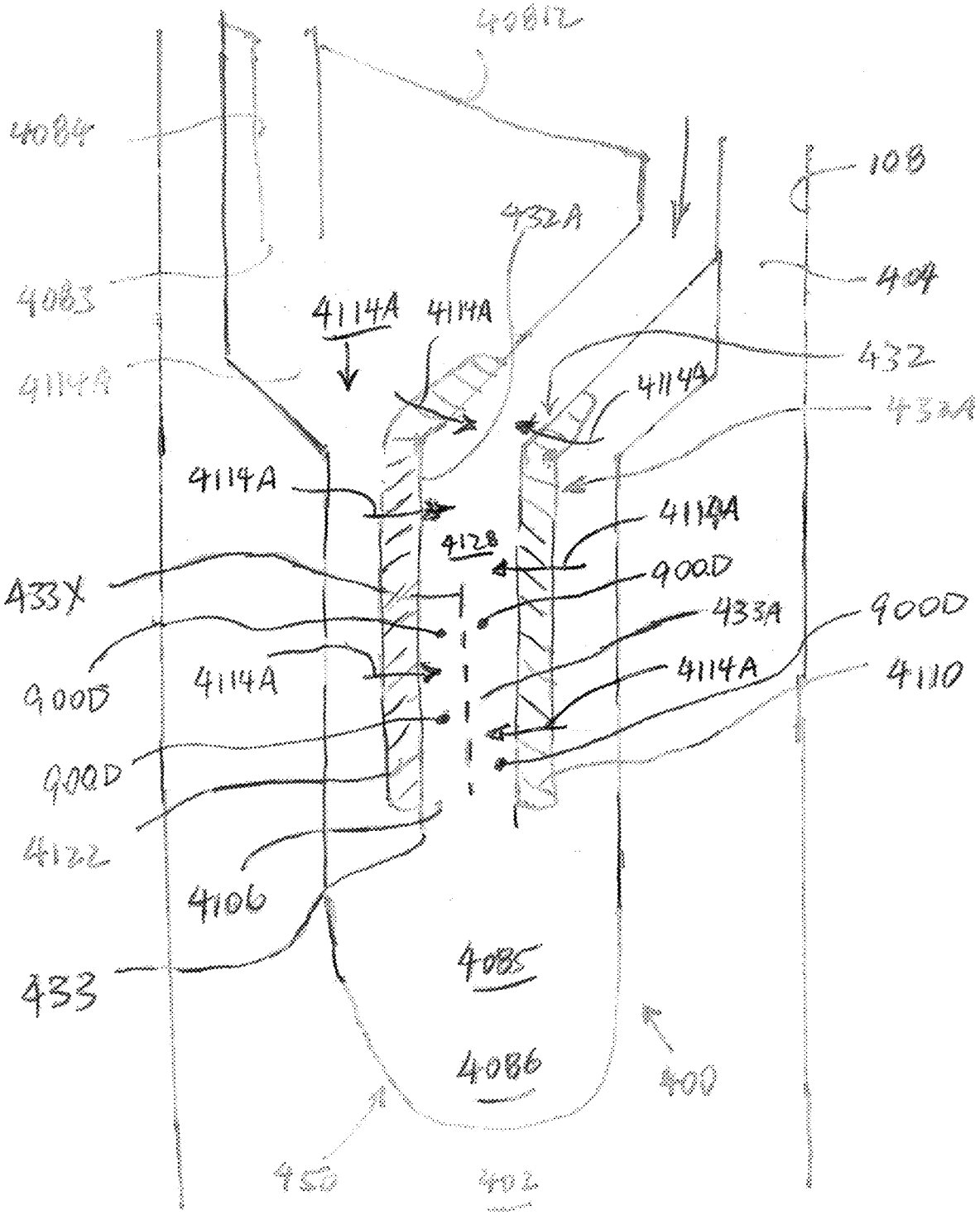
FIG. 18D is an enlarged portion of Detail "A" of the embodiment illustrated in FIG. 17, disposed in a flow reversal configuration.

Referring to FIGS. 18C and 18D, in some embodiments, for example, fluid flow, through the filtering medium 4122, is reversed, with effect that release of at least a fraction of the accumulated solid material 900A, that is adhered to the filtering medium 4122 within the filtering medium-traversing portion 432A, is stimulated.

In this respect, the system 10 is configurable in a production-effective configuration (see FIG. 18C) and a flow reversal configuration (see FIG. 18D). In the production-effective configuration, the system 10 is configured for generating the gas-depleted reservoir fluid flow 415, such that, while the gas-depleted reservoir fluid flow 415 is being generated, the reservoir fluid-derived fluid flow 411 is being conducted in the uphole direction (and in a downwardly direction), the accumulated solid material is becoming adhered to the filtering medium 4122, such that adhered solid material 900C is obtained, and an uphole-disposed reservoir fluid-derived fluid material 4114A becomes disposed uphole relative to the filtering medium 4122. In the flow reversal configuration, the system 10 is configured such that, while the uphole-disposed reservoir fluid-derived fluid material 4114A is disposed uphole relative to the filtering medium 4122, the uphole-disposed reservoir fluid-derived fluid material 4114A is conductible through the filtering medium 4122 in the downhole direction. The system 10 is transitionable from the production-effective configuration to the flow reversal configuration such that, while the system 10 is disposed in the flow reversal configuration, the adhered solid material 900C is adhered to the filtering medium 4122, and the uphole-disposed reservoir fluid-derived fluid material 4114A is being conducted in the downhole direction via the fluid passage 800, the adhered solid material 900A becomes released from the filtering medium 4122, such that the adherence of the adhered solid material 900C to the filtering medium 4122 is defeated, and such that released solid material 900D is obtained.

In some embodiments, for example, the pump 300 of the system 10 is a rod pump. In some of these embodiments, for example, the system 10 is disposed in the production-effective configuration while the pump is disposed in the pump cavity-filling configuration (FIG. 20B) such that the travelling valve 306 is closed and the standing valve 310 is open, and the conveyor 302 is being displaced in the uphole direction. Transitioning from the production-effective configuration to the flow reversal configuration is effectuated in response to emplacement of the conveyor 302 at the uphole displacement limit, such that uphole displacement of the conveyor 302 is suspended. In some embodiments, for example, the flow reserval configuration is effective only while the standing valve 310 is open. In some embodiments, for example, the flow reversal configuration becomes ineffective in response to the closure of the standing valve 310 (i.e. in response to the pump 300 becoming disposed in the uphole-disposed movement reversal configuration (FIG. 20C)).

As explained above, in response to the suspension of the uphole displacement of the conveyer 302, over a pressure equalization time interval, fluid, disposed immediately downhole of the standing valve 306 (e.g. within the space 314), becomes disposed in fluid pressure equilibrium with fluid disposed within the pump cavity 312, such that there is an absence of a pressure differential across the closure member 3106. As a result, the closure member 3106 becomes seated on the seat 3104 due to the force of gravity applied to the closure member 3106, and flow of reservoir fluid through the standing valve 310 is prevented. In response to the suspension of the uphole displacement of the travelling valve 306, relative to the standing valve 310, because, initially, the closure member 3106 is unseated relative to the seat 3104 (as the pressure equalization is not immediate), flow of the uphole-disposed reservoir fluid-derived fluid material 4114A is induced in the downhole direction, towards the subterranean formation, via the fluid passage 800. As described above, such flow is useful for releasing the adhered solid material 900C, such that the released solid material 900D is obtained. After the pressure equalization time interval, once pressure is equalized and the closure member 3106 becomes seated on the seat 3104, this flow of the uphole-disposed reservoir fluid-derived fluid material 4114A becomes suspended.

In some embodiments, for example, the system 10 is also configurable in a released solids settling configuration, and the released solids settling configuration is obtainable in response to transitioning from the flow reversal configuration to the released solids settling configuration. In the released solids settling configuration, while the uphole-disposed reservoir fluid-derived fluid material 4114A is disposed uphole relative to the filtering medium 4122 and is being conducted in the downhole direction via the fluid passage 800, the flow of the uphole-disposed reservoir fluid-derived fluid material 4114A, in the downhole direction, is at least reduced (such as, for example, suspended), such that the released solid material 900D is conducted, in response to at least gravity, to the solid settling zone 4085 via the flow discharging communicator 4106.

In those embodiments where the pump 300 is a rod pump, in some of these embodiments, for example, the released solids settling configuration is defined during the uphole-disposed movement reversal configuration (FIG. 20C), during the pump cavity-evacuation configuration (FIG. 20D), or both of the uphole-disposed movement reversal configuration and the pump cavity-evacuation configuration.

In this respect, a method is also provided, and the method includes establishing the adhered solid material 900C, which is adhered to the filtering medium 4122, while the system 10 is disposed in the production-effective configuration. In those embodiments where the pump 300 is a rod pump, in some of these embodiments, for example, the system 10 is disposed in the production-effective configuration while the pump 300 is disposed in the pump cavity-filling configuration (FIG. 20B). After the establishing of the adhered solid material 900A, stimulating the release of the adhered solid material 900C from the filtering medium 4122 by establishing flow reversal through the filtering medium 4122. In those embodiments where the pump 300 is a rod pump, in some of these embodiments, for example, the flow reversal is established after suspension of the uphole displacement of the conveyer 302, and prior to the seating of the closure member 3106 on the seat 3104. In some embodiments, for example, the flow reserval is effective only while the standing valve 310 is open. In some embodiments, for example, the flow reversal is suspended in response to the closure of the standing valve (i.e. in response to the pump 300 becoming disposed in the uphole-disposed movement reversal configuration (FIG. 20C)). After the stimulation of the release of the adhered solid material 900C from the filtering medium, the released solid material 900D is conducted, in response to at least gravity, to the solid settling zone 4085 via the flow discharging communicator 4106 (such as, for example, during the uphole-disposed movement reversal configuration (FIG. 20C), during the pump cavity-evacuation configuration (FIG. 20D), or both of the uphole-disposed movement reversal configuration and the pump cavity-evacuation configuration).

Figure 14:
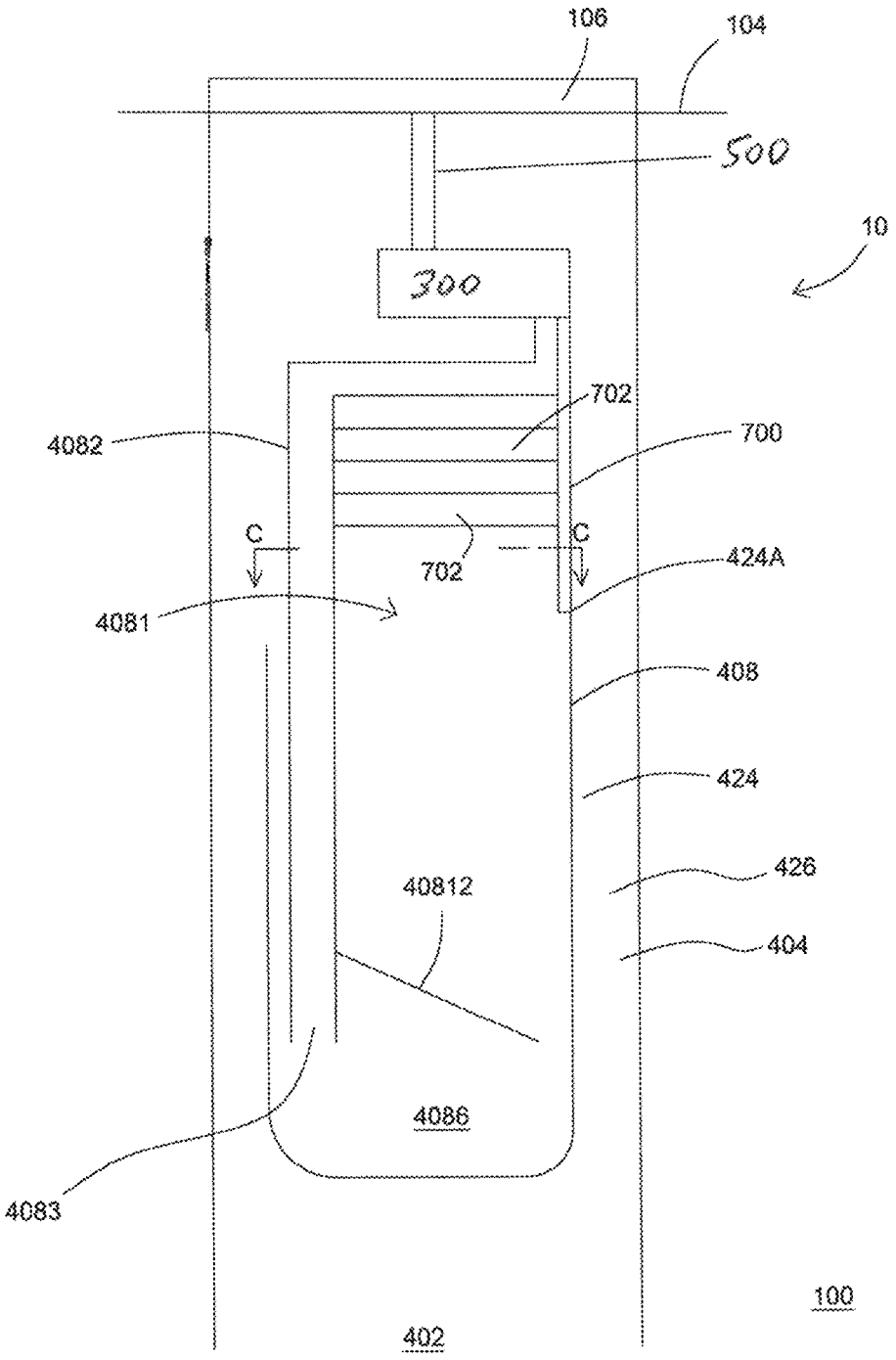
FIG. 14 is a schematic illustration of another embodiment of the present disclosure.
Figure 15:
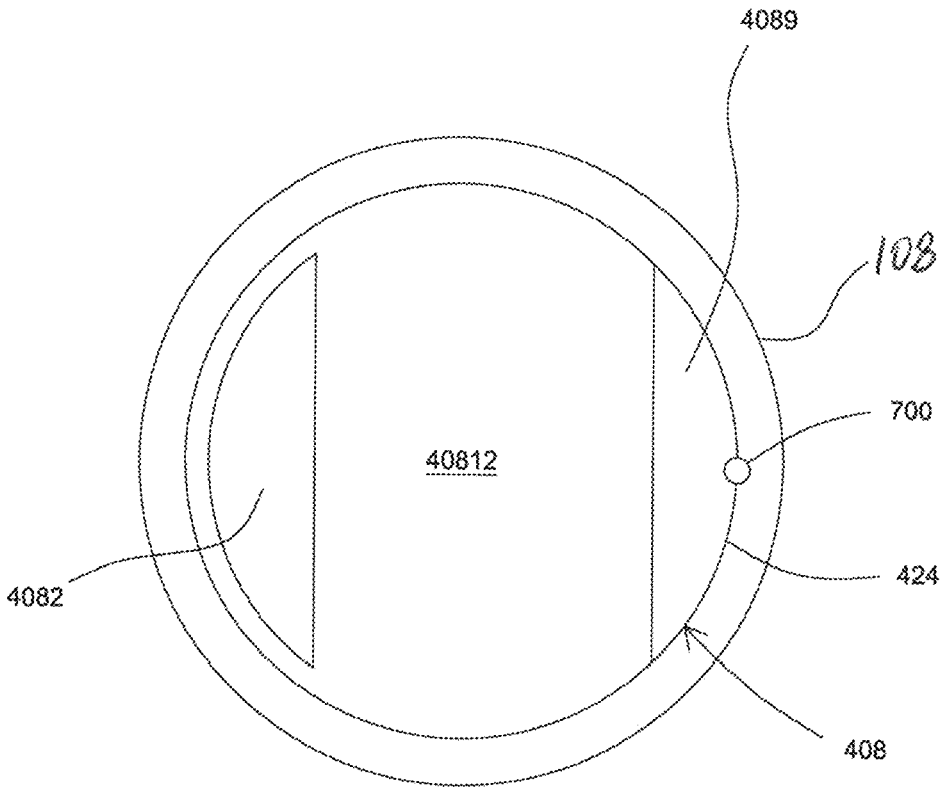
FIG. 15 is a schematic illustration of a sectional view taken along lines C-C in FIG. 14.

Referring to FIGS. 14 and 15, in some embodiments, for example, the shroud 424 is supported by an elongated member 700 connected to the gas-depleted reservoir fluid flow conductor 4082. In some embodiments, for example, the elongated member is in the form of a rigid bar. In some embodiments, for example, the rigid bar has a maximum cross-sectional area of less than 0.5 square inches. In some embodiments, for example, the elongated member 700 is connected to the gas-depleted reservoir fluid flow conductor 4082 with a plurality of gusset braces 702. In this respect, for each one of the gusset braces 702, independently, the gusset brace 702 connects a respective portion of the elongated member 700 to a counterpart portion of the gas-depleted reservoir fluid flow conductor 4082.

Figure 16:
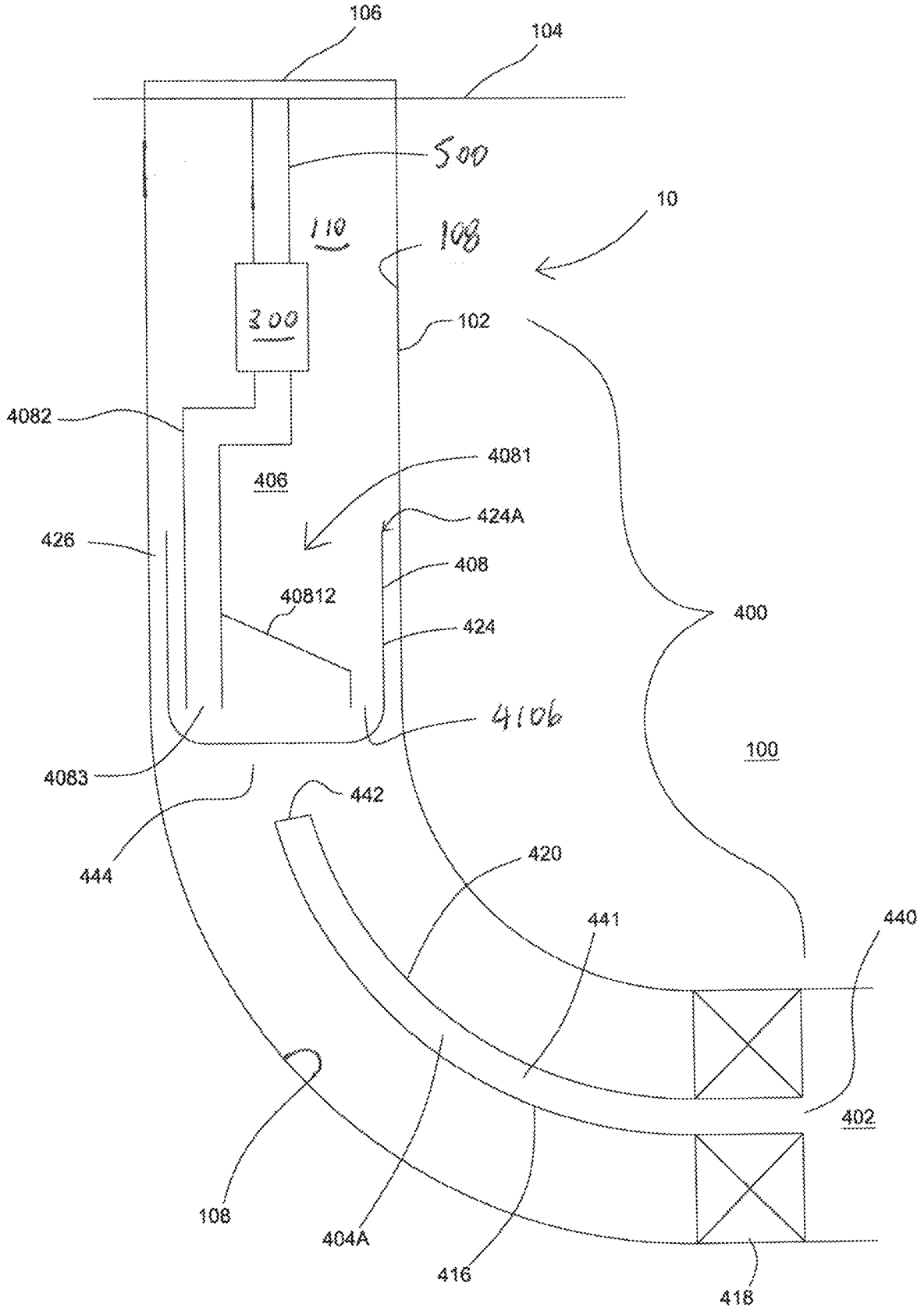
FIG. 16 is a schematic illustration of another embodiment of the present disclosure.

Referring to FIG. 16, in some embodiments, for example, the separator 400 further includes a reservoir flow conductor 416 and a sealed interface effector 418 (such as, for example, a packer). At least a portion 404A of the reservoir fluid-conducting passage 404 is defined within the reservoir flow conductor 416. The sealed interface effector 418 is mounted to the reservoir flow conductor 416 such that the reservoir flow conductor 416 is sealingly engaged to the wellbore string 108 via the sealed interface effector 418.

In some embodiments, for example, at least a portion of the reservoir flow conductor 416 is a velocity string 420. In some embodiments, for example, the at least a portion of the reservoir flow conductor 416 is the entirety of the reservoir flow conductor 416, such that, in such embodiments, the velocity string is the reservoir flow conductor 416. In some embodiments, for example, the sealing engagement of the reservoir flow conductor 416 to the wellbore string 108 is a sealing engagement of the velocity string 420 to the wellbore string. In this respect, in some embodiments, for example, the sealed interface effector 418 is mounted to the velocity string 420.

In those embodiments where at least a portion of the reservoir flow conductor 416 is a velocity string 420, in some of these embodiments, for example, the velocity string 420 is characterized by a maximum cross-sectional flow area, and the maximum cross-sectional flow area is smaller than the minimum cross-sectional flow area of the reservoir fluid-receiving space 402. In some of these embodiments, for example, the ratio of the minimum cross-sectional flow area of the reservoir fluid-receiving space 402 to the maximum cross-sectional flow area of the reservoir fluid conducting passage portion 404A, defined by the velocity string 420, is at least 1.5.

In those embodiments where at least a portion of the reservoir flow conductor 416 is a velocity string 420, in some of these embodiments, for example, at least a portion of the velocity string 420 is disposed within a heel portion 108 of the wellbore 102. In some embodiments, for example, the velocity string 420 extends through the heel portion 108.

In some embodiments, for example, the reservoir flow conductor 416 includes a flow receiving communicator 440 (such as, for example, an inlet port), a flow discharging communicator 442 (such as, for example, an outlet port), and a reservoir flow conductor flow passage 441. The reservoir flow conductor flow passage 441 defines a portion of the reservoir fluid-conducting passage 404. The flow receiving communicator 440 is disposed for receiving the reservoir fluid from the reservoir fluid-receiving zone 402 such that the conducting of the reservoir fluid, by the reservoir fluid-conducting passage 404, is effected while the reservoir fluid is being received by the flow receiving communicator 440 from the reservoir fluid-receiving zone 402. The reservoir flow conductor flow passage 441 is effective for conducting the reservoir fluid received by the flow receiving communicator 440 to the flow discharging communicator 442. The flow discharging communicator 442 is effective for discharging the reservoir fluid from the reservoir flow conductor 416.

The flow diverter 408, the wellbore string 108, the reservoir flow conductor 416, and the sealed interface effector 418 are co-operatively configured such that:

- the intermediate passage 426 is disposed between the flow diverter 408 and the wellbore string 108 and defines another portion of the reservoir fluid-conducting passage 404;
- the flow discharging communicator 442 is disposed in flow communication with the reservoir fluid gas separation zone 406 via the intermediate passage 426;
- while reservoir fluid is being discharged from the flow discharging communicator 442, the discharged reservoir fluid is diverted by the sealed interface effector 418 to the intermediate passage 426 for conduction to the uphole wellbore zone 405.

In some of these embodiments, for example, the flow diverter 408 is disposed above the flow discharging communicator 442, such that a bubble coalescent zone 444 is defined between the flow discharging communicator 442 and the flow diverter 408. In some embodiments, for example, the minimum spacing distance from the flow discharging communicator 442 to the flow diverter 408 is at least five (5) feet, such as, for example, at least ten (10) feet, such as, for example, at least 20 feet, such as, for example, at least 30 feet. In some embodiments, for example, the minimum spacing distance from the flow discharging communicator 442 to the intermediate passage is at least five (5) feet, such as, for example, at least ten (10) feet, such as, for example, at least 20 feet, such as, for example, at least 30 feet. The minimum cross-sectional flow area of the bubble coalescent zone 444 is greater than the maximum cross-sectional flow area of the reservoir fluid conducting passage portion 404A of the reservoir flow conductor 416 (such as, for example, the velocity string 420). In some embodiments, for example, the ratio, of the minimum cross-sectional flow area of the bubble coalescent zone 444 to the maximum cross-sectional flow area of the reservoir fluid conducting passage portion 404A of the reservoir flow conductor 416 (such as, for example, the velocity string 420), is at least 1.5. The bubble coalescent zone 444 is configured to reduce the velocity of the reservoir fluid flow being discharged from the reservoir flow conductor 416, and mitigate turbulent flow conditions, so as to promote bubble coalescence, which facilitates the separation within the gas separation zone 406. In this respect, the conducting of the reservoir fluid from the reservoir fluid-receiving space 402 to the gas separation zone 406 is effected via at least the reservoir fluid-conducting passage portion 404A of the reservoir flow conductor 416 (such as, for example, the velocity string 420), the bubble coalescent zone 444, and the intermediate space 426.

In the above description, for purposes of explanation, numerous details are set forth in order to provide a thorough understanding of the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. Therefore, it will be understood that certain adaptations and modifications of the described embodiments can be made and that the above discussed embodiments are considered to be illustrative and not restrictive. All references mentioned are hereby incorporated by reference in their entirety.

What is claimed is:

1. A downhole separator, implacable within a wellbore string passage of a wellbore string that is lining a wellbore, for effectuating separation of a reservoir fluid flow, received within a reservoir fluid-receiving zone of the wellbore from a subterranean formation, into at least a gas-depleted reservoir fluid flow and a gas-enriched reservoir fluid flow, wherein:

the separator is configured to co-operate with the wellbore string, wherein the co-operation is with effect that:

flow communication is established between the reservoir fluid-receiving zone and an uphole wellbore zone; and reservoir fluid flow, received within the reservoir fluid-receiving zone, is conducted uphole to the uphole wellbore zone, with effect that the reservoir fluid flow is separated into at least the gas-depleted reservoir fluid flow and the gas-enriched reservoir fluid flow, wherein the separation includes separation in response to buoyancy forces within a gas separation zone; and the separator comprises:

a flow diverter configured to co-operate with the gas separation zone for diverting the separated gas-depleted reservoir fluid flow such that the separated gas-depleted reservoir fluid flow is conducted in an upwardly direction;

wherein:

the flow diverter includes:

a reservoir fluid-derived flow conductor effective for conducting a reservoir fluid-derived flow, derived from the uphole wellbore zone-disposed reservoir fluid flow, with effect that a downwardly-displaced reservoir fluid-derived flow, derived from the reservoir fluid-derived flow, becomes emplaced below the uphole wellbore zone, wherein the upwardly conducted gas-depleted reservoir fluid is derived from the downwardly-displaced reservoir fluid-derived flow, wherein the reservoir fluid-derived flow conductor includes a filter-communicating flow conductor portion, a solids filtering apparatus, a permeate discharging communicator, and a retentate discharging communicator; wherein:

the solids filtering apparatus includes a filtering medium for effectuating the separation;

the filter-communicating flow conductor portion, the solids filtering apparatus, the permeate discharging communicator, and the retentate discharging communicator are co-operatively configured such that, while the reservoir fluid-derived flow is being conducted by the reservoir fluid-derived flow conductor, a downwardly-flowing reservoir fluid-derived flow becomes emplaced within the filter communicating flow conductor portion, and in response to the emplacement of the downwardly-flowing reservoir fluid-derived flow within the filter communicating flow conductor portion: the downwardly-flowing reservoir fluid-derived fluid flow becomes disposed in mass transfer communication with the solids filtering apparatus, with effect that the downwardly-flowing reservoir fluid-derived flow is separated into a first solids-depleted reservoir fluid-derived fluid flow and a downwardly-flowing solids-enriched reservoir fluid-derived flow, with effect that: (i) the first solids-depleted reservoir fluid-derived flow is discharged from the flow conductor via a permeate discharging communicator, disposed below the uphole wellbore zone, (ii) the downwardly-flowing solids-enriched reservoir fluid-derived flow is discharged from the flow conductor via the retentate discharging communicator, disposed below the uphole wellbore zone, with effect that the downwardly-flowing solids-enriched reservoir fluid-derived flow becomes emplaced in a solids settling zone, and while disposed in the solids settling zone, the solids-enriched reservoir fluid-derived flow becomes depleted in solid material in response to gravity separation such that a second solids-depleted reservoir fluid-derived flow is obtained, and (iii) at least a portion of the downwardly-displaced reservoir fluid-derived flow is derived from the first solids-depleted reservoir fluid; and the filter communicating flow conductor portion and the filtering medium are co-operatively configured such that mass transfer communication, between the downwardly-flowing reservoir fluid-derived flow and the solids filtering apparatus is established as the downwardly-flowing reservoir fluid-derived flow is traversing the filtering medium, and the traversing of the filtering medium is effectuated while the downwardly-flowing reservoir fluid-derived flow is flowing through a filtering medium-traversing portion of the filter communicating flow conductor portion, and the filtering medium-traversing portion defines a filtering medium-communication effecting flow passage, and the filtering medium-communication effecting flow passage, through which the downwardly-flowing reservoir fluid-derived flow is conducted while traversing the filtering medium, has a total volume "V1", and the filtering medium, traversed by the conducting of the downwardly-flowing reservoir fluid-derived flow, has a total surface area "A1", and the ratio of the total surface area "A1" to the total volume "V1" is at least 0.013.

2. The separator as claimed in claim 1; wherein:

the discharging of the downwardly-flowing solids-enriched reservoir fluid-derived flow, from the flow conductor via the retentate discharging communicator, is with effect that the downwardly-flowing solids-enriched reservoir fluid-derived flow becomes disposed below permeate discharging communicator.

3. The separator as claimed in claim 1; wherein:

the first solids-depleted reservoir fluid-derived flow and the second solids-depleted reservoir fluid-derived flow combine to define the downwardly-displaced reservoir fluid-derived flow.

4. The separator as claimed in claim 1; wherein:

the traversing of the filtering medium by the downwardly-flowing reservoir fluid-derived flow is with effect that the downwardly-flowing reservoir fluid-derived flow is conducted in a cross-flow orientation relative to the filtering medium.

5. The separator as claimed in claim 4; wherein:

the filter-communicating flow conductor portion and the filtering medium are co-operatively configured such that the mass transfer communication, between the downwardly-flowing reservoir fluid-derived flow and the solids filtering apparatus, is established as the downwardly-flowing reservoir fluid-derived flow is traversing the filtering medium, and the traversing of the filtering medium is effectuated while the downwardly-flowing reservoir fluid-derived flow is flowing through a filtering medium-traversing portion of the filter communicating flow conductor portion, and the filtering medium-traversing portion defines a filtering medium-communication effecting flow passage having an axial length of at least five (5) feet.

6. The separator as claimed in claim 5; wherein:

the discharging of the downwardly-flowing solids-enriched reservoir fluid-derived flow, from the flow conductor via the retentate discharging communicator, is with effect that the downwardly-flowing solids-enriched reservoir fluid-derived flow becomes disposed below permeate discharging communicator.

7. The separator as claimed in claim 6; wherein:

the first solids-depleted reservoir fluid-derived flow and the second solids-depleted reservoir fluid-derived flow combine to define the downwardly-displaced reservoir fluid-derived flow.

8. The separator as claimed in claim 5; wherein:

the first solids-depleted reservoir fluid-derived flow and the second solids-depleted reservoir fluid-derived flow combine to define the downwardly-displaced reservoir fluid-derived flow.

9. The separator as claimed in claim 4; wherein:

the discharging of the downwardly-flowing solids-enriched reservoir fluid-derived flow, from the flow conductor via the retentate discharging communicator, is with effect that the downwardly-flowing solids-enriched reservoir fluid-derived flow becomes disposed below permeate discharging communicator.

10. The separator as claimed in claim 9; wherein:

the first solids-depleted reservoir fluid-derived flow and the second solids-depleted reservoir fluid-derived flow combine to define the downwardly-displaced reservoir fluid-derived flow.

11. The separator as claimed in claim 4; wherein:

the first solids-depleted reservoir fluid-derived flow and the second solids-depleted reservoir fluid-derived flow combine to define the downwardly-displaced reservoir fluid-derived flow.

12. The separator as claimed in claim 1; wherein:

the filter-communicating flow conductor portion and the filtering medium are co-operatively configured such that the mass transfer communication, between the downwardly-flowing reservoir fluid-derived flow and the solids filtering apparatus, is established as the downwardly-flowing reservoir fluid-derived flow is traversing the filtering medium, and the traversing of the filtering medium is effectuated while the downwardly-flowing reservoir fluid-derived flow is flowing through a filtering medium-traversing portion of the filter communicating flow conductor portion, and the filtering medium-traversing portion defines a filtering medium-communication effecting flow passage having an axial length of at least five (5) feet.

13. The separator as claimed in claim 12; wherein:

the traversing of the filtering medium by the downwardly-flowing reservoir fluid-derived flow is with effect that the downwardly-flowing reservoir fluid-derived flow is conducted in a cross-flow orientation relative to the filtering medium.

14. The separator as claimed in claim 13; wherein:

the discharging of the downwardly-flowing solids-enriched reservoir fluid-derived flow, from the flow conductor via the retentate discharging communicator, is with effect that the downwardly-flowing solids-enriched reservoir fluid-derived flow becomes disposed below permeate discharging communicator.

15. The separator as claimed in claim 14; wherein:

the first solids-depleted reservoir fluid-derived flow and the second solids-depleted reservoir fluid-derived flow combine to define the downwardly-displaced reservoir fluid-derived flow.

16. The separator as claimed in claim 12; wherein:

the discharging of the downwardly-flowing solids-enriched reservoir fluid-derived flow, from the flow conductor via the retentate discharging communicator, is with effect that the downwardly-flowing solids-enriched reservoir fluid-derived flow becomes disposed below permeate discharging communicator.

17. The separator as claimed in claim 16; wherein:

the first solids-depleted reservoir fluid-derived flow and the second solids-depleted reservoir fluid-derived flow combine to define the downwardly-displaced reservoir fluid-derived flow.

18. The separator as claimed in claim 12; wherein:

the first solids-depleted reservoir fluid-derived flow and the second solids-depleted reservoir fluid-derived flow combine to define the downwardly-displaced reservoir fluid-derived flow.

* * * * *